US009726999B2

(12) United States Patent
Kitajima

(10) Patent No.: US 9,726,999 B2
(45) Date of Patent: Aug. 8, 2017

(54) IMAGE FORMING APPARATUS

(71) Applicant: CANON KABUSHIKI KAISHA, Tokyo (JP)

(72) Inventor: Kenichiro Kitajima, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/953,602

(22) Filed: Nov. 30, 2015

(65) Prior Publication Data

US 2016/0161878 A1 Jun. 9, 2016

(30) Foreign Application Priority Data

Dec. 3, 2014 (JP) ..... 2014-245425

(51) Int. Cl.
*G03G 15/02* (2006.01)
*G03G 13/02* (2006.01)

(52) U.S. Cl.
CPC ..... *G03G 15/0266* (2013.01); *G03G 13/02* (2013.01); *G03G 15/0283* (2013.01); *G03G 15/0291* (2013.01); *G03G 2215/026* (2013.01); *G03G 2215/027* (2013.01)

(58) Field of Classification Search
CPC ..... G03G 15/0266; G03G 15/0283; G03G 15/0291; G03G 13/02; G03G 2215/026; G03G 2215/027
See application file for complete search history.

(56) References Cited

U.S. PATENT DOCUMENTS 3,678,350 A * 7/1972 Matsumoto ..... G03G 15/0266 250/325
4,423,134 A * 12/1983 Miyakawa ..... G03G 15/065 399/245
5,659,839 A * 8/1997 Mizude ..... G03G 15/0266 399/50
6,055,401 A * 4/2000 Tonomoto ..... G03G 15/09 399/269
6,205,303 B1 * 3/2001 Fujii ..... G03G 15/0258 399/100
6,463,226 B2 10/2002 Kitajima et al.
(Continued)

FOREIGN PATENT DOCUMENTS

JP 62194267 A 8/1987

*Primary Examiner* — Ryan Walsh
(74) *Attorney, Agent, or Firm* — Fitzpatrick, Cella, Harper & Scinto

(57) ABSTRACT

An image forming apparatus includes a rotatable photosensitive member (drum), a first corona charger, a second corona charger, an image forming portion, a voltage applying portion, a surface potential detecting portion, a controller. The controller determines a condition of voltages applied to the first and second corona chargers during image formation, by setting a first voltage condition for the first corona charger so that the surface potential of the drum is a second potential lower in absolute value than the first potential in a state in which the first corona charger operates, and the second corona charger does not operates, and then by setting a second voltage condition for the second corona charger so that the surface potential of the drum is the first potential in a state in which the first corona charger operates under the first voltage condition, and the second corona charger operates.

26 Claims, 14 Drawing Sheets

(56) References Cited

U.S. PATENT DOCUMENTS

| | | | | |
|---|---|---|---|---|
| 6,559,876 | B2 | 5/2003 | Kitajima et al. | |
| 6,785,480 | B2 | 8/2004 | Toyohara et al. | |
| 6,826,375 | B2 | 11/2004 | Kitajima | |
| 7,031,628 | B2 * | 4/2006 | Sekovski | G03G 15/0266 399/171 |
| 2005/0220468 | A1 | 10/2005 | Kitajima | |
| 2007/0160389 | A1 * | 7/2007 | Zona | G03G 15/0291 399/170 |
| 2008/0199206 | A1 * | 8/2008 | Zona | G03G 15/0258 399/100 |
| 2010/0067936 | A1 | 3/2010 | Kitajima | |
| 2010/0322668 | A1 * | 12/2010 | Takishita | G03G 15/0291 399/170 |

* cited by examiner (a)

(b)

(a)

(b)

IMAGE FORMING APPARATUS

FIELD OF THE INVENTION AND RELATED ART

The present invention relates to an image forming apparatus, such as a copying machine or a printer, of an electrophotographic type.

In a conventional image forming apparatus of an electrophotographic type, as a charging means for electrically charging an electrophotographic photosensitive member, a corona charger has been widely used. However, in the case where a high moving speed of the photosensitive member with speed-up of an image output is intended to be realized or a photosensitive member large in electrostatic capacity is charged, such as a problem of "charging non-uniformity" that a surface potential of the photosensitive member becomes non-uniform due to an insufficient charging performance of the corona charger generates in some cases.

When the charging non-uniformity generates, in some cases, an image defect such as "image density non-uniformity" or "graininess" due to a variation in image dot generates. As a countermeasure to achieve uniformity of the surface potential of the photosensitive member, a technique as described below has been proposed.

Japanese Laid-Open Patent Application (JP-A) Sho 62-194267 proposes that two corona chargers are arranged along a movement direction of a photosensitive member to meet speed-up of image output.

In this conventional method, the surface potential of the photosensitive member is adjusted to a target potential by adjusting a voltage applied to an upstream corona charger so that a current flowing through a grid electrode of a downstream corona charger is a predetermined value. In the case of such a method, in the case where the voltage applied to a discharging electrode of the downstream corona charger fluctuates or the like and thus a current supplied to the discharging electrode fluctuates, the charging non-uniformity of the photosensitive member generates in some cases.

SUMMARY OF THE INVENTION

A principal object of the present invention is to suppress charging non-uniformity of a photosensitive member.

According to an aspect of the present invention, there is provided an image forming apparatus comprising: a rotatable photosensitive member; a first corona charger for electrically charging the photosensitive member; a second corona charger, provided downstream of the first corona charger with respect to a rotational direction of the photosensitive member, for electrically charging a surface of the photosensitive member to a first potential set in advance in superposition on a charged surface of the photosensitive member charged by the first corona charger; image forming means for forming an image on the photosensitive member charged by the first corona charger and the second corona charger; voltage applying means for applying voltages to the first corona charger and the second corona charger; detecting means, provided downstream of the second corona charger with respect to the rotational direction of the photosensitive member, for detecting a surface potential of the photosensitive member; and control means for controlling the voltages applied to the first corona charger and the second corona charger, wherein the control means determines a condition of the voltages applied to the first corona charger and the second corona charger during image formation, by setting a first voltage condition for the first corona charger so that the surface potential of the photosensitive member is a second potential lower in absolute value than the first potential in a state in which the first corona charger operates, and said second corona charger does not operates, and then by setting a second voltage condition for said second corona charger so that the surface potential of said photosensitive member is the first potential in a state in which the first corona charger operates under the first voltage condition, and the second corona charger operates.

Further features of the present invention will become apparent from the following description of exemplary embodiments with reference to the attached drawings.

DESCRIPTION OF THE EMBODIMENTS

An image forming apparatus according to the present invention will be described specifically with reference to the drawings.

Embodiment 1

1. General Structure and Operation of Image Forming Apparatus

Figure 1:
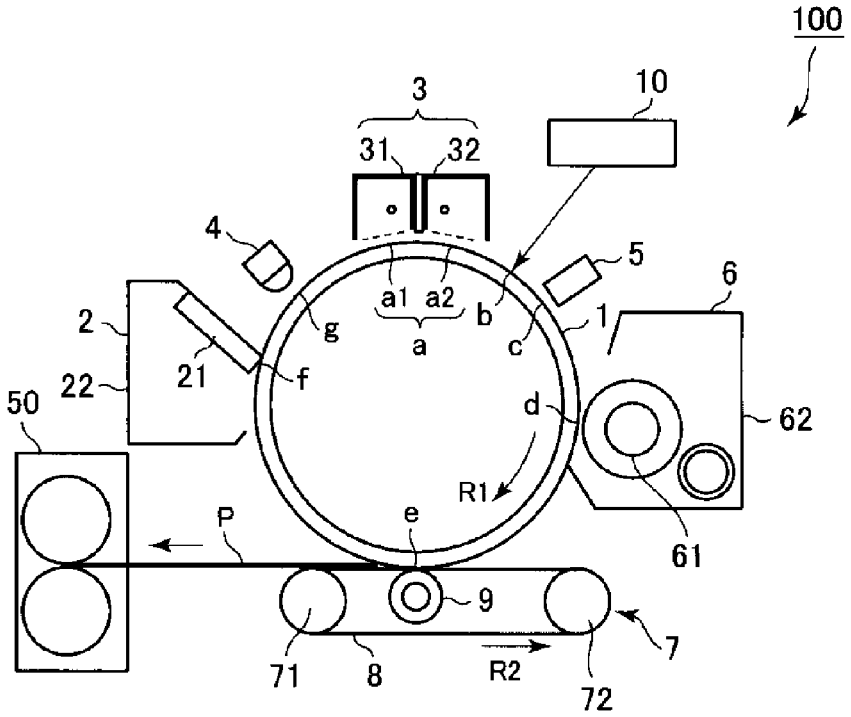
FIG. 1 is a schematic sectional view of an image forming apparatus according to Embodiment 1.

FIG. 1 is a schematic sectional view of an image forming apparatus 100 according to Embodiment 1 of the present invention. The image forming apparatus 100 in this embodiment is a laser beam printer.

The image forming apparatus 100 includes a photosensitive drum 1 which is a drum-shaped (cylindrical) electrophotographic photosensitive member. The photosensitive drum 1 is rotated in an arrow R1 direction in FIG. 1. Around the photosensitive drum 1, along a rotational direction of the photosensitive drum 1, the following devices are provided. First, as a charging means, a charging device 3 is disposed. Next, as an image exposure means, an exposure device (laser scanner) 10 is disposed. Next, as a developing means, a developing device 6 is disposed. Next, as a transfer means, a transfer device 7 of a transfer belt type is disposed. Next, as a cleaning means, a cleaning device 2 is disposed. Next, as a charge-removing means, a light charge-remaining device 4 is disposed.

The transfer device 7 includes a transfer belt 8 which is a recording material feeding member formed with a rotatable endless belt provided opposed to the photosensitive drum 1. The transfer belt 8 is supported by a driving roller 71 and a follower roller 72 which are a plurality of supporting rollers, and a driving force is transmitted by the driving roller 71 which is rotationally driven, so that the transfer belt 8 is rotated (circulated and moved) in an arrow R2 direction in FIG. 1. In an inner peripheral surface side of the transfer belt 8, at a position opposing the photosensitive drum 1, a transfer roller 9 as a transfer member is provided. The transfer roller 9 is urged (pressed) toward the photosensitive drum 1 via the transfer belt 8 to form a transfer portion e which the photosensitive drum 1 and the transfer belt 8 are in contact with each other.

In a side downstream of the transfer portion e with respect to a feeding direction of a recording material P, a fixing device 50 of a heat pressing type as a fixing means is provided.

During image formation, an outer peripheral surface of the rotating photosensitive drum 1 is electrically charged uniformly to a predetermined potential of a predetermined polarity (negative in this embodiment) by the charging device 3. At this time, to the charging device 3, predetermined voltages are applied from charging voltage sources S1, S2, s3, S4, S5 (FIG. 2) as a voltage applying means. In this embodiment, the charging device 3 is constituted by an upstream charger 31 (first corona charger) provided in an upstream side with respect to a rotational direction (surface movement direction) of the photosensitive drum 1 and a downstream charger 32 (second corona charger) provided in a downstream side with respect to the rotational direction of the photosensitive drum 1. With respect to the rotational direction of the photosensitive drum 1, a position on the photosensitive drum 1 where the photosensitive drum is charged by the charging device 3 is a charging portion (charging position) a. Specifically, with respect to the rotational direction of the photosensitive drum 1, a position where the photosensitive drum 1 is charged by the upstream charger 31 is a upstream charging portion (upstream charging position) a1, and a position where the photosensitive drum 1 is charged by the downstream charger 32 is a downstream charging portion (downstream charging position) a2. The charging device 3 and voltages (charging voltage, charging bias) applied thereto will be described later in detail.

The surface of the photosensitive drum 1 subjected to the charging process is subjected to scanning exposure to laser light depending on image information. As a result, an electrostatic latent image (electrostatic image) depending on the image information is formed on the photosensitive drum 1. With respect to the rotational direction of the photosensitive drum 1, an exposure position on the photosensitive drum 1 by the exposure device 10 is an image exposure portion (image exposure position) b.

The electrostatic latent image formed on the photosensitive drum 1 is developed (visualized) with a toner as a developer by the developing device 6. The developing device 6 includes a developing roller 61 as a developer carrying member. The developing roller 61 carries and feeds the toner accommodated in a developing container 62, and supplies the toner to the photosensitive drum 1 depending on the electrostatic latent image. In this embodiment, a toner image is formed by image portion exposure and reverse development. That is, on an image portion lowered in absolute value of a potential by being subjected to the light exposure after the photosensitive drum 1 is uniformly charged, the toner charged to the same polarity as a charge polarity of the photosensitive drum 1 is deposited. During development, to the developing roller 61, a predetermined developing voltage (developing bias) is applied from an unshown developing voltage source. With respect to the rotational direction, a position on the photosensitive drum 1 opposing the developing roller 61 is a developing portion (developing position) d where the toner is supplied from the developing roller 61.

The toner image formed on the photosensitive drum 1 is electrostatically transferred at the transfer portion e onto the recording material P such as recording paper which is carried on the transfer belt 8 and which is nipped and fed by the photosensitive drum 1 and the transfer belt 8. At this time, to the transfer roller 9, from an unshown transfer voltage source, a transfer voltage (transfer bias) which is a DC voltage of an opposite polarity to a (normal) charge polarity of the toner during the development is applied. With respect to the rotational direction of the photosensitive drum 1, a position of contact of the photosensitive drum 1 with the transfer belt 8 is the transfer portion (transfer position) e where the toner image transfer is made.

The recording material P on which the toner image is transferred is separated from the transfer belt 8 and then is fed to the fixing device 50. The fixing device 50 feeds the recording material P while heating and pressing the recording material P, so that the toner image is fixed on the recording material P. Thereafter, the recording material P is discharged to an outside of an apparatus main assembly of the image forming apparatus 100.

The toner (transfer residual toner) remaining on the photosensitive drum 1 after a transfer step is removed and collected from the photosensitive drum 1 by the cleaning device 2. The cleaning device includes a cleaning blade 21 as a cleaning member provided in contact with the photosensitive drum 1 and includes a collecting container 22 in which the toner scraped off from the rotating photosensitive drum 1 by the cleaning blade 21 is collected. With respect to the rotational direction of the photosensitive drum 1, a position of contact of the photosensitive drum 1 with the cleaning blade 21 is a cleaning portion (cleaning position) f.

The photosensitive drum 1 subjected to cleaning by the cleaning device 2 is irradiated with light (charge-removing light) by the light charge-removing device 4 to remove residual electric charges. Thereafter, the photosensitive drum 1 is electrically charged again by the charging device 3. With respect to the rotational direction of the photosensitive drum 1, a position where the photosensitive drum 1 is exposed to the light by the light charge-removing device 4 is a charge-removing portion (charge-removing position) g.

The potential sensor 5 detects a surface potential of the photosensitive drum 1 in a charging voltage adjusting operation described specifically later. The potential sensor 5 is disposed opposed to the surface of the photosensitive drum 1 so as to be capable of detecting the surface potential of the photosensitive drum 1 in an image formable region (region where the toner image can be formed) with respect to a longitudinal direction of the photosensitive drum 1. In this embodiment, the potential sensor 5 detects the surface potential of the photosensitive drum 1 between the charging portion a (particularly, the downstream charging portion a2) and the developing portion d (specifically, between the image exposure portion b and the developing portion d) with respect to the rotational direction of the photosensitive drum 1. With respect to the rotational direction of the photosensitive drum 1, a position where the surface potential of the photosensitive drum 1 is detected by the potential sensor 5 is a potential detecting portion (potential detecting position) c.

In this embodiment, a wavelength of the image exposure light by the exposure device 10 is 675 nm. Further, in this embodiment, an exposure amount of the surface of the photosensitive drum 1 by the exposure device 10 is variable in a range of 0.1-0.5 $\mu J/cm^2$, and a predetermined exposed portion potential can be formed by adjusting the exposure amount depending on a developing condition.

In this embodiment, a wavelength of the charge-removing light by the light charge-removing device 4 is 635 nm. In this embodiment, as a light source for the light charge-removing device 4, an LED chip array was used. An exposure amount of the surface of the photosensitive drum 1 by the light charge-removing device 4 is adjustable in a range of 1.0-7.0 $\mu J/cm^2$. In this embodiment, the exposure amount was set at 4.0 $\mu J/cm^2$.

2. Photosensitive Drum

The photosensitive drum 1 is supported rotatably by the apparatus main assembly of the image forming apparatus 100. The photosensitive drum 1 is a cylindrical photosensitive member constituted by an electroconductive support of aluminum or the like and a photoconductive layer formed on an outer peripheral surface of the support. The photosensitive drum 1 is rotationally driven in an arrow R1 direction in FIG. 1 by a driving means (not shown).

In this embodiment, the charge polarity of the photosensitive drum 1 is negative. In this embodiment, the photosensitive drum 1 is an amorphous silicon photosensitive member of 84 mm in outer diameter. In this embodiment, the photosensitive layer is 40 μm in thickness and 10 in dielectric constant. In this embodiment, the photosensitive drum 1 is 700 mm/s in peripheral speed. The photosensitive drum 1 may also be another photosensitive member such as an OPC (organic photoconductor).

3. Charging Device

Figure 2:
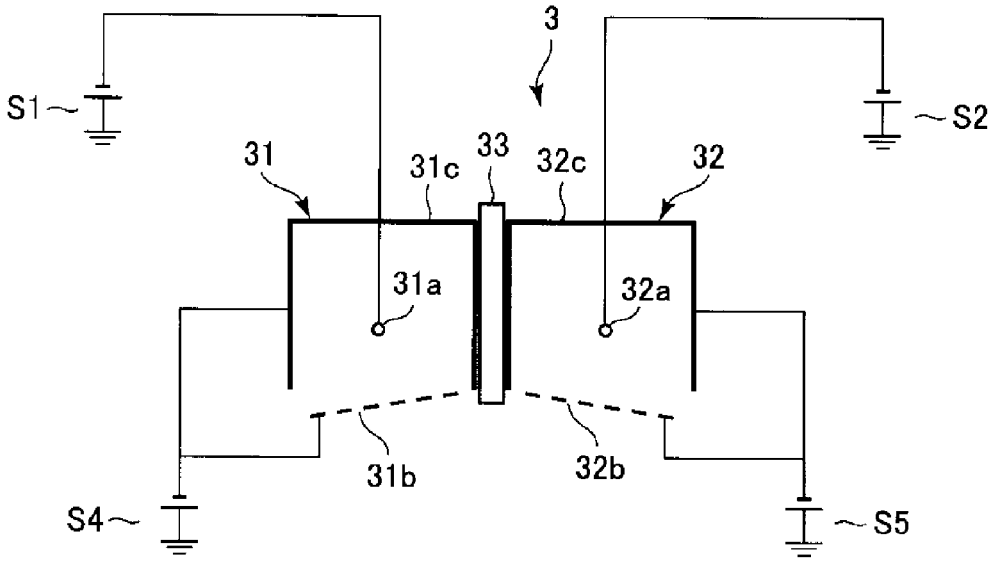
FIG. 2 is a schematic sectional view of a charging device in the Embodiment 1.

FIG. 2 is a schematic sectional view of the charging device 3 in this embodiment. The charging device 3 is constituted by the upstream charger 31 and the downstream charger 32 which are two scorotron chargers as a plurality of corona chargers. With respect to the rotational direction of the photosensitive drum 1, the upstream charger 31 and the downstream charger 32 are disposed from an upstream side toward a downstream side in this order. The upstream charger 31 and the downstream charger 32 have substantially the same constitution. The upstream charger 31 and the downstream charger 32 include discharge wires (wire electrodes, discharge electrodes) 31*a*, 32*a*, grid electrodes 31*b*, 32*b* and shield electrodes 31*c*, 32*c*. Incidentally, in the following description, elements and various parameters for each of the upstream charger 31 and the downstream charger 32 are distinguished from each other by adding the prefix "upstream" or "downstream" in some cases.

Each of the discharge wires 31*a*, 32*a* is constituted by an electroconductive wire disposed in a linear shape along a longitudinal direction (rotational axis direction) of the photosensitive drum 1. Each of the grid electrodes 31*b*, 32*b* is constituted by an electroconductive flat plate-like member which as a plurality of openings and which is disposed along the longitudinal direction of the photosensitive drum 1 between the associated discharge wire 31*a* or 32*a* and the photosensitive drum 1. Each of the shield electrodes 31*c*, 32*c* are formed to surround the discharge wires 31*a*, 32*a*, respectively, and is constituted by an electroconductive substantially box-like member provided with an opening where the associated grid electrode 31*b* or 32*b* is disposed in an opposing side to the photosensitive drum 1. Between the upstream charger 31 and the downstream charger 32, an insulating member 33 for preventing generation of leakage when different biases are applied to the upstream shield electrode 31*c* and the downstream shield electrode 32*c*. In this embodiment, as the insulating member 33, an insulating plate constituted by an electrically insulating material of about 2 mm in thickness T (with respect to a tangential direction of the develop 1 in FIG. 3) was used.

Figure 3:
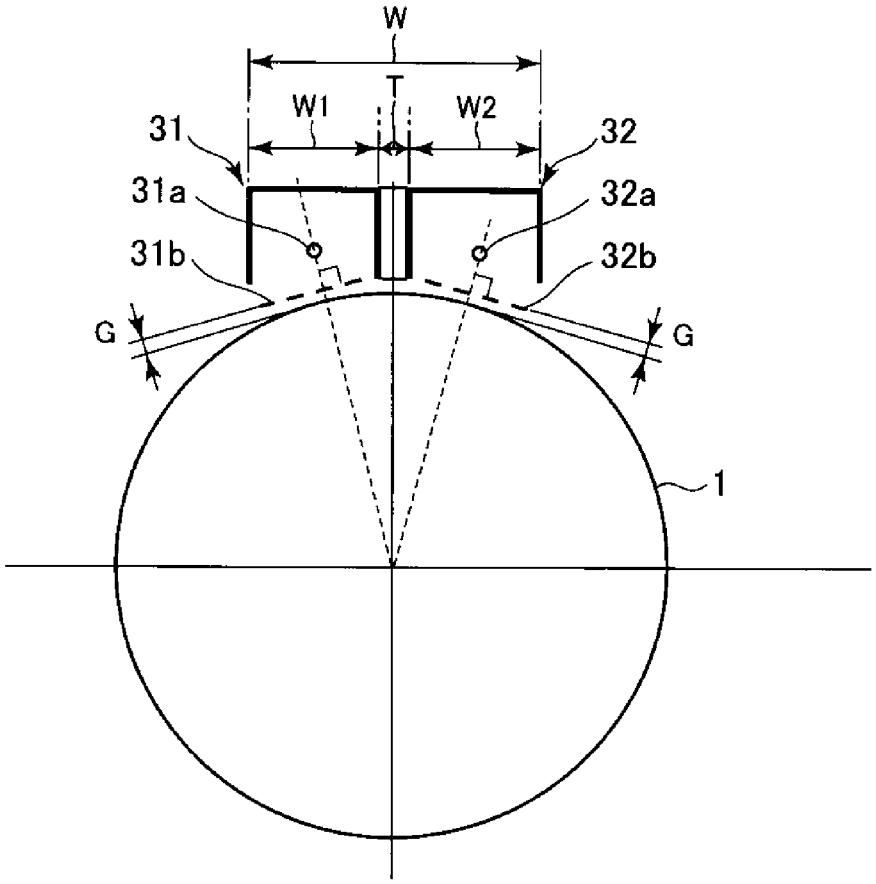
FIG. 3 is a schematic view showing an arrangement of a grid electrode of the charging device in the Embodiment 1.

The charging device 3 is 42 mm in width W (with respect to the tangential direction of the photosensitive drum 1 in FIG. 3) and is 340 mm in length with respect to a longitudinal direction of a discharge region (with respect to the longitudinal direction of the develop 1). Widths W1 and W2 (with respect to the tangential direction of the photosensitive drum 1 in FIG. 3) of the upstream charger 31 and the downstream charger 32, respectively, are 20 mm, i.e., the same.

As each of the discharge wires 31*a*, 32*a*, a discharge wire which was constituted by a tungsten wire subjected to oxidation and which was 60 μm in wire diameter (outer diameter) and was used in an electrophotographic image forming apparatus in general was used.

The grid electrodes 31*b*, 32*b* have the plate-like shape. As shown in FIG. 3, each of the upstream grid electrode 31*b* and the downstream grid electrode 32*b* is disposed along curvature of the photosensitive drum 1 so that the grid electrodes 31*b* and 32*b* have different angles (inclination angles). In a cross-section substantially perpendicular to the longitudinal direction of the photosensitive drum 1, an arrangement angle of each of the grid electrodes 31*b*, 32*b* is a substantially right angle with respect to a rectilinear line connecting the associated discharge wire 31*a* or 32*a* with the rotation center of the photosensitive drum 1. Each of the grid electrodes 31*b*, 32*b* is disposed with the closest gap G with the photosensitive drum 1 of 1.25±0.2 mm.

The upstream grid electrode 31*b* is 90% in aperture (ratio), and the downstream grid electrode 32*b* is 80% in aperture (ratio). Each of the grid electrodes 31*b*, 32*b* is a mesh-shaped grid electrode subjected to etching. As each of the grid electrodes 31*b*, 32*b*, a grid electrode which was constituted by an SUS (stainless steel) plate and which has a surface layer formed as an anti-corrosive layer such as a nickel-plated layer and was used in general for electrophotography, was used. Incidentally, there is no need that the apertures of the grid electrodes 31*b*, 32*b* of the upstream charger 31 and the downstream charger 32, respectively, are different from each other, and commonality of the guide electrodes may be achieved between the plurality of chargers by using the grid electrodes having the same aperture.

4. Voltage Application to Charging Device

As shown in FIG. 2, the upstream discharge wire 31*a* and the downstream discharge wire 32*a* are connected to an upstream discharge voltage source S1 and a downstream discharge voltage source S2, respectively, which are DC voltage sources (high-voltage sources), so that voltages applied to the discharge wires 31*a*, 32*a* can be independently controlled. The upstream grid electrode 31*b* and the downstream grid electrode 32*b* are connected to an upstream grid voltage source S4 and a downstream grid voltage source S5, respectively, which are DC voltage sources, so that voltages applied to the grid electrodes 31*b*, 32*b* can be independently controlled.

The upstream shield electrode 31*c* and the downstream shield electrode 32*c* are connected with the upstream grid electrode 31*b* and the downstream grid electrode 32*b*, respectively. In this way, in this embodiment, in the upstream charger 31 and the downstream charger 32, the shield electrodes 31*c*, 32*c* and the grid electrodes 31*b*, 32*b* have the same potential. However, each of the shield electrodes 31*c*, 32*c* may also be electrically grounded by being connected to, e.g., the ground electrode of the apparatus main assembly of the image forming apparatus 100 without being made equipotential to the associated grid electrode 31*b* or 32*b*. The only requirement is that the voltages applied to the upstream charger 31 and the downstream charger 32 are independently controllable and that in the upstream charger 31 and the downstream charger 32, the voltages applied to the discharge wires 31*a*, 32*a* and the grid electrodes 31*b*, 32*b* are independently controllable.

Figure 4:
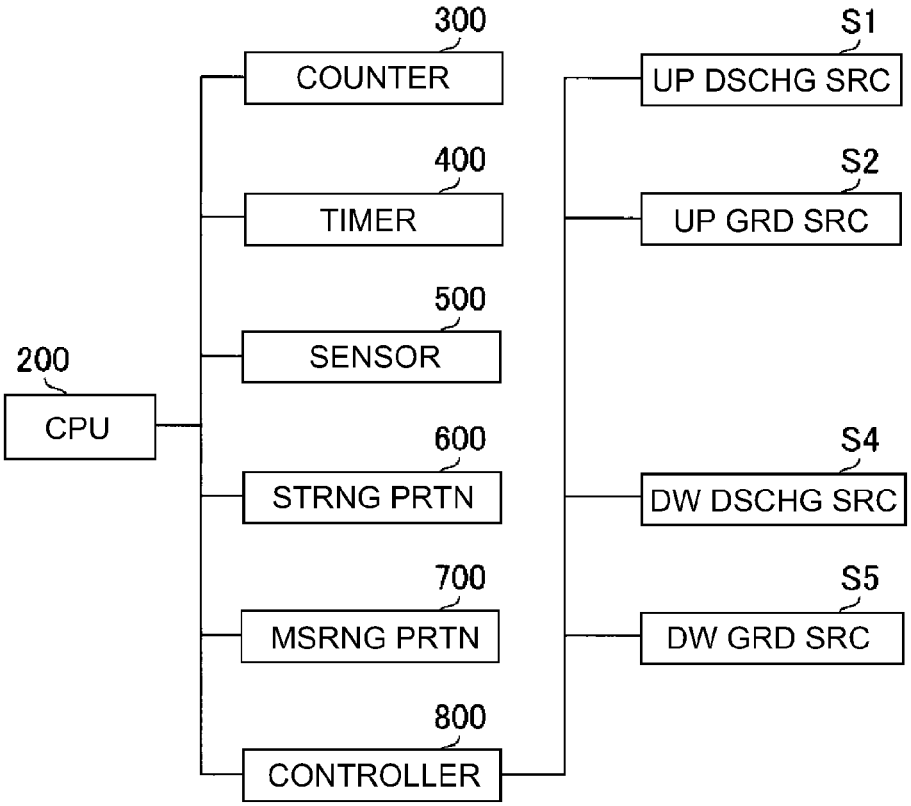
FIG. 4 is a block diagram of a control circuit of a charging voltage in the Embodiment 1.

FIG. 4 is a block diagram showing control of the charging voltage in this embodiment. As shown in FIG. 4, the voltage sources S1, S2, S4, S5 are connected to CPU 200 as a control means. Further, to the CPU 200, a sheet number (print number) counter 300, a timer 400, an environment sensor 500, a storing portion 600, a surface potential measuring portion 700, a high-voltage output controller 800 and the like are connected. The sheet number counter 300 counts the number of sheets subjected to image output by the image forming apparatus 100. The timer 400 measures an elapsed time from a reference point of time. The environment sensor 500 measures temperatures and humidities of the air inside and outside the image forming apparatus 100. The storing portion 600 records control data of the charging voltage and a measurement result of the surface potential of the photosensitive drum 1. The surface potential measuring portion 700 processes a detection result of the potential sensor 5 (sensor output) and provides the CPU 200 with information showing a measurement result. The high-voltage controller 800 controls ON/OFF of outputs of the voltage sources S1, S2, S4, S5 and output values of these voltage sources under control of the CPU 200.

The CPU 200 effects processing described later on the basis of pieces of information from the sheet number counter 300, the timer 400, the environment sensor 500 and the storing portion 600, and provides an instruction to the high-voltage output controller 800, thus controlling the voltage sources S1, S2, S4, S5.

In this embodiment, the DC voltages applied to the discharge wire 31*a*, 32*a* are subjected to constant-current control, and are changeable in a range of 0 to −3200 μA. In this embodiment, the DC voltage applied to the grid electrodes 31*b*, 32 are subjected to constant-voltage control, and are changeable in a range of 0 to −1200 V.

5. Control of Surface Potential of Photosensitive Drum

In this embodiment, the voltages applied to the plurality of chargers 31 and 32 of the charging device 3 can be independently controlled. In addition, in this embodiment, such a charging voltage-adjusting operation that the surface potentials formed on the photosensitive drum 1 by independently controlling the voltages applied to the chargers of the charging device 3 in the order of the upstream charger 31 and the downstream charger 32 are successively superposed (synthesized) is performed. As a result, a final desired surface potential (charge potential, dark-portion potential) of the photosensitive drum 1 is controlled. That is, in this embodiment, in the charging voltage-adjusting operation, first, the voltage applied to the upstream charger 31 is independently controlled to electrically charge the photosensitive drum 1, so that a predetermined surface potential is formed on the photosensitive drum 1. Then, in a state in which a voltage controlled so as to form the predetermined surface potential is applied to the upstream charger 31, the voltage applied to the downstream charger 32 is independently controlled to further charge the photosensitive drum 1. As a result, the surface potential formed by the downstream charger 32 is superposed on (synthesized with) the surface potential formed by the upstream charger 31, so that the final desired surface potential of the photosensitive drum 1 is formed.

In the following description, parameters as to the charging process by the upstream charger 31 are represented by adding a suffix "(U)", and parameters as to the charging process by the downstream charger 32 are represented by adding a suffix "(D)". Further, parameters at the potential detecting portion c are represented by adding a suffix "sens", and parameters at the developing portion d are represented by adding a suffix "dev". Further, with respect to magnitude relationships of the voltages, the currents and the potentials, they will be described in terms of absolute values. For example, "−400 V or more" refers to, e.g., the case of "−500 V".

5-1. Charging Process by Upstream Charger

First, the charging process by the upstream charger 31 will be described. The upstream charger 31 charges the photosensitive drum 1 under application of an upstream discharge current (DC current) Ip(U) from the upstream discharge voltage source S1 to the discharge wire 31*a* in a state in which a predetermined upstream grid voltage Vg(U) is applied from the upstream grid voltage source S4 to the upstream grid electrode 31*b*.

Figure 5:
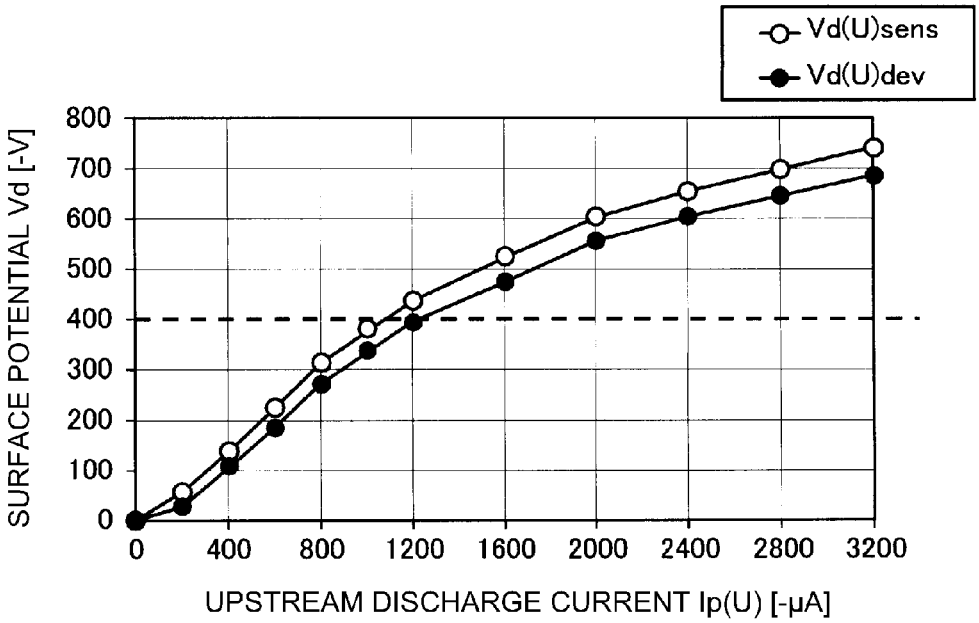
FIG. 5 is a graph showing a relationship between an upstream discharge current of an upstream charger and a surface potential of a photosensitive drum in the Embodiment 1.

FIG. 5 shows a relationship between the upstream discharge current Ip(U) and the surface potential of the photosensitive drum 1 after being charged by the upstream charger 31. As shown in FIG. 5, the surface potential formed on the photosensitive drum 1 varies depending on the upstream discharge current Ip(U). In this embodiment, in the case where the upstream grid voltage Vg(U) is −700 V and the upstream discharge current Ip(U) is −1200 μA, the surface potential of the photosensitive drum 1 is −450 V at the potential detecting portion c and −400 V at the developing portion d.

In this embodiment, a dark decay amount of the surface potential of the photosensitive drum 1 is about 50 V between the potential detecting portion c and the developing portion d.

In this embodiment, the voltage applied to the upstream charger 31 is adjusted so that a surface potential Vd(U)sens of the photosensitive drum 1 at the potential detecting portion c is −450 V (and a surface potential Vd(U)dev of the photosensitive drum 1 at the developing portion d is −400 V) while adjusting the upstream discharge current Ip(U) in a variable change manner.

5-2. Charging Process by Downstream Charger

Next, the charging process by the downstream charger 32 will be described. Adjustment of the voltage applied to the downstream charger 32 is made in a state in which the above-described charging process by the upstream charger 31 is continued. The downstream charger 32 charges the photosensitive drum 1 under application of a downstream discharge current (DC current) Ip(S) from the downstream discharge voltage source S2 to the downstream discharge wire 32*a* in a state in which a predetermined downstream grid voltage Vg(S) is applied from the downstream grid voltage source S5 to the downstream grid electrode 32*b*.

Figure 6:
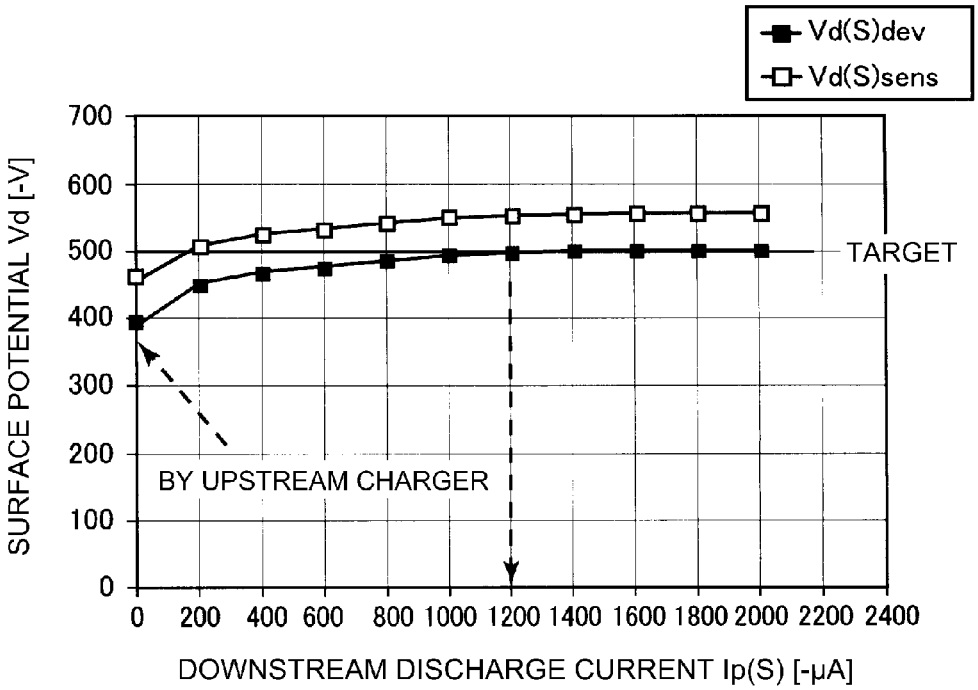
FIG. 6 is a graph showing a relationship between a downstream discharge current of a downstream charger and the surface potential of the photosensitive drum in the Embodiment 1.

FIG. 6 shows a relationship between the downstream discharge current Ip(S) and the surface potential of the photosensitive drum 1 after being charged by the downstream charger 32. As shown in FIG. 6, the surface potential formed on the photosensitive drum 1 varies depending on the downstream discharge current Ip(S). In this embodiment, in the case where the downstream grid voltage Vg(S) is −600 V and the downstream discharge current Ip(S) is −1200 μA, the surface potential of the photosensitive drum 1 is −550 V at the potential detecting portion c and −500 V at the developing portion d.

Figure 7:
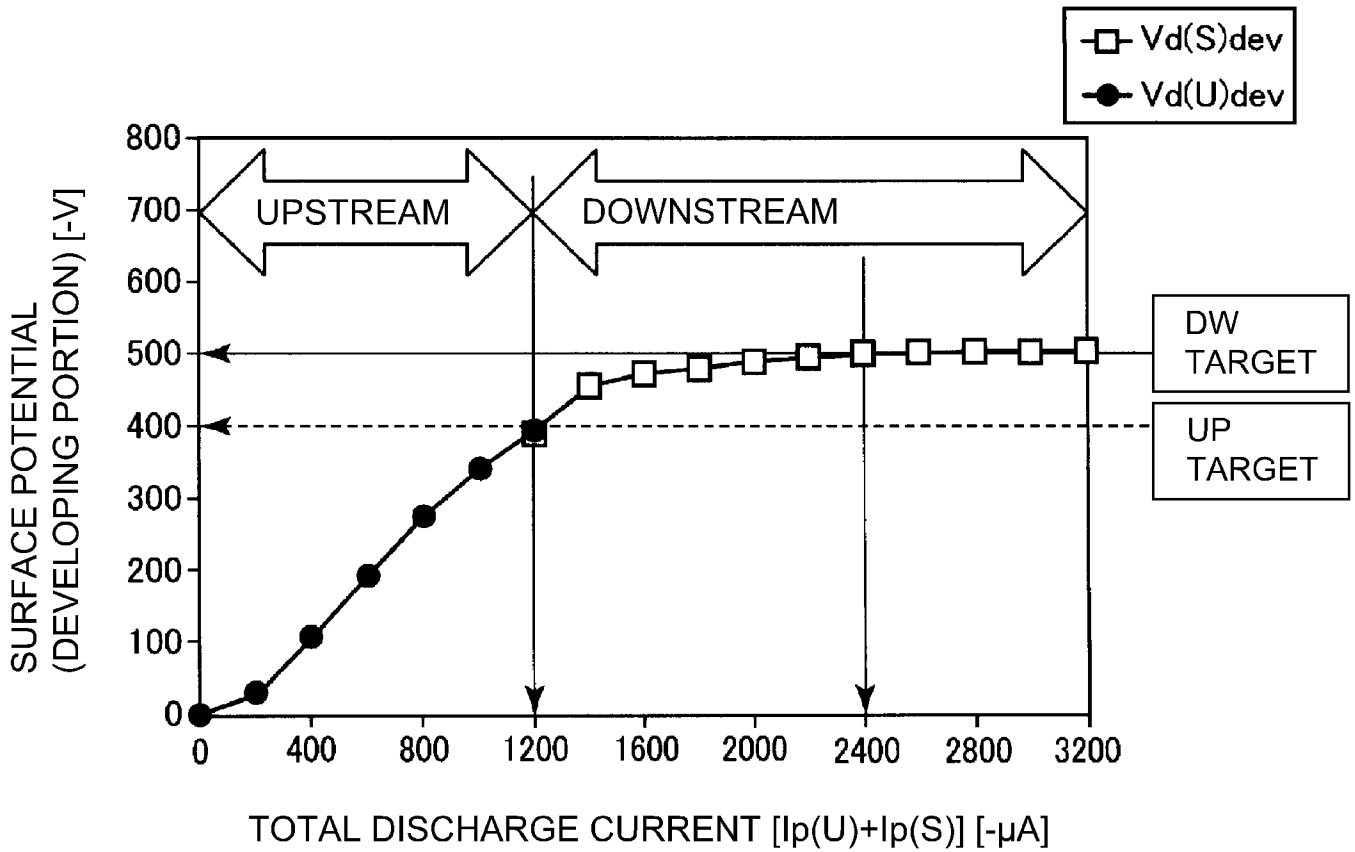
FIG. 7 is a graph showing a relationship between a total discharge current, of the upstream charger and the downstream charger, and the surface potential of the photosensitive drum in the Embodiment 1.

5-3. Relationship Between Potentials Formed by Upstream Charger and Downstream Charger FIG. 7 shows a relationship between the surface potential (at the developing portion d) formed on the photosensitive drum 1 by successively charging the photosensitive drum 1 by the upstream charger 31 and the downstream charger 32 in a superposition (synthesis) manner. A range in which the total discharge current of the abscissa up to −1200 μA shows a region charged by the upstream charger 31. A range in which the total discharge current of the abscissa of −1200 μA or more (in absolute value) shows a region charged by the upstream charger 31 and the downstream charger 32 in a state in which the upstream discharge current Ip(U) is fixed at −1200 μA.

From FIG. 7, it is understood that in a region of −2400 μA or more in total discharge current, the surface potential Vd(S)dev (the surface potential at the developing portion d) is constant relative to the total discharge current. That is, it is understood that in this region, a uniform surface potential can be formed on the photosensitive drum 1 with no charging non-uniformity.

Figure 8:
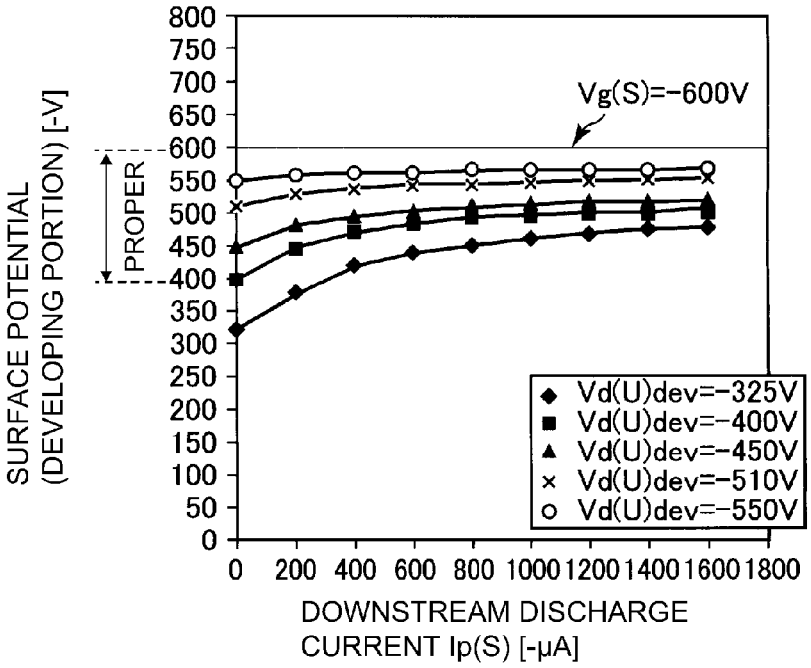
In FIG. 8, (a) is a graph showing a relationship between the downstream discharge current and the surface potential of the photosensitive drum in the Embodiment 1, and (b) is a graph showing a relationship between the downstream discharge current and a slope of a change in potential in the Embodiment 1.
Figure 8:
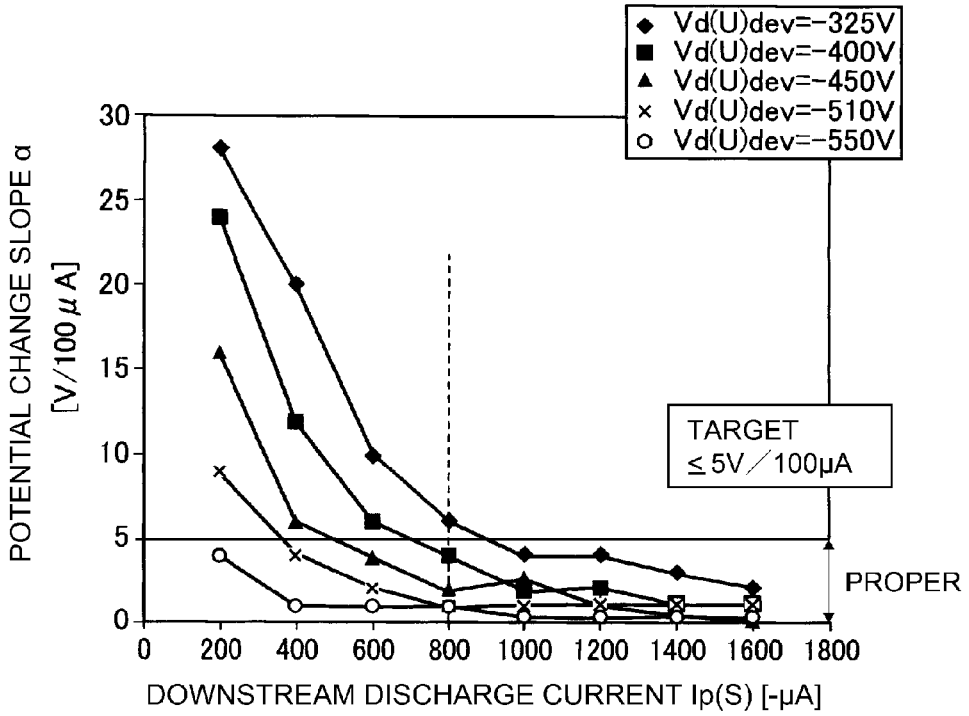

Next, referring to (a) of FIG. 8, setting of the surface potential, formed on the photosensitive drum 1 by the upstream charger 31, which is desired in order to obtain a good convergence property of the surface potential of the photosensitive drum 1. In FIG. 8, (a) shows a relationship between the downstream discharge current Ip(S) and the surface potential Vd(S)dev of the photosensitive drum 1 after charged by the downstream charger 32 in the case where the surface potential Vd(U)dev formed on the photosensitive drum 1 by the upstream charger 31 is changed. The downstream grid voltage Vg(S) was fixed at −600 V.

From (a) of FIG. 8, it is understood that when the surface potential formed on the photosensitive drum 1 by the upstream charger 31 is changed, a charging characteristic of the photosensitive drum 1 relative to the downstream discharge current Ip(S) is changed. When the surface potential formed on the photosensitive drum 1 by the upstream charger 31 is small, a proportion of the surface potential formed on the photosensitive drum 1 by the downstream charger 32 becomes large. For that reason, the downstream discharge current Ip(S) necessary to converge the surface potential of the photosensitive drum 1 at a target surface potential (target potential, charging potential, dark-portion potential) increases.

In this embodiment, in consideration of a lowering in downstream discharge current Ip(S), the downstream discharge current Ip(S) is made not more than −1600 μA, and the surface potential Vd(S)dev of the photosensitive drum 1 at the developing portion d is made −500 V which is a target potential. For that purpose. in this embodiment, from a result of (a) of FIG. 8, the surface potential formed on the photosensitive drum 1 by the upstream charger 31 is made not less than −400 V at the developing portion d (not less than −450 V at the potential detecting portion c). On the other hand, in this embodiment, the surface potential formed on the photosensitive drum 1 by the upstream charger 31 is made not more than −600 V (as the downstream grid voltage Vg(S)) at the developing portion d. This range of the surface potential of the photosensitive drum 1 is a proper range of the surface potential formed on the photosensitive drum 1 by the upstream charger 31.

The reason why the surface potential of the photosensitive drum 1 by the upstream charger 31 is made not more than the downstream grid voltage Vg(S) at the developing portion d is as follows. That is, when the surface potential larger than the downstream grid voltage Vg(S) is supplied to the downstream charger 32, the convergence property of the surface potential of the photosensitive drum 1 with respect to the downstream grid voltage Vg(S) lowers. As a result, the surface potential formed on the photosensitive drum 1 by the downstream charger 31 passes through the downstream charger 32 in that state, so that a charging non-uniformity eliminating performance by the downstream charger 32 lowers. The surface potential Vd(U)der of the photosensitive drum 1 at the developing portion d after the photosensitive drum 1 is charged by the upstream charger 31 is made not more than the downstream grid voltage Vg(S), so that the convergence property of the surface potential of the photosensitive drum 1 with respect to the downstream grid voltage Vg(S) was good.

In this embodiment, from the result of (a) of FIG. 8, the surface potential formed on the photosensitive drum 1 by the upstream charger 31 was set at −400 V at the developing portion d (−450 V at the potential detecting portion c). As a result, the surface potential formed on the photosensitive drum 1 by the downstream charger 32 was able to be converged at −500 V which was the target potential at the developing portion d.

In this embodiment, a dark decay amount of the surface potential of the photosensitive drum 1 is about 50 V from the potential detecting portion c to the developing portion d as described above. In this embodiment, a dark decay amount of the surface potential of the photosensitive drum 1 is about 50 V from the downstream charging portion a2 to the potential detecting portion c. For that reason, when the target potential of the photosensitive drum 1 at the developing portion d after the charging process of the photosensitive drum 1 by the upstream charger 31 is −400 V, the surface potential of the photosensitive drum 1 is −450 V at the potential detecting portion c and is −500 V at the downstream charging portion a2. Accordingly, the surface potential formed on the photosensitive drum 1 by the upstream charger 31 is set at −400 V at the developing portion d and thus also the surface potential of the photosensitive drum 1 at the downstream charging portion a2 can be made not more than −600 V. However, as described above, when the surface potential formed on the photosensitive drum 1 by the upstream charger 31 is small, the downstream discharge current Ip(S) necessary to converge the surface potential of the photosensitive drum 1 at the target potential increases. For that reason, a difference between the downstream grid voltage Vg(S) and the surface potential Vd(U) formed on the photosensitive drum 1 by the upstream charger 31 may preferably be 200 V or less. That is, $|Vg(S)|-|VD(U)|\leq|200(V)|$ may preferably be satisfied. Specifically, a preferred result can be obtained by making the difference, between the downstream grid voltage Vg(S) and the surface potential Vd(U)dev of the photosensitive drum 1 at the developing portion d after the charging process by the upstream charger 31, not more than 200 V. In general, this difference is smaller at the second charging portion a2.

Next, referring to (b) of FIG. 8, setting of the downstream discharge current Ip(S), which is desired in order to obtain a good convergence property of the surface potential of the photosensitive drum 1. In FIG. 8, (b) shows a relationship between the downstream discharge current Ip(S) and a change amount in surface potential Vd(U)dev relative to a change of 100 μA in downstream discharge current Ip(S) in the case where the surface potential Vd(U)dev formed on the photosensitive drum 1 by the upstream charger 31 is changed. The downstream grid voltage Vg(S) was fixed at −600 V.

From (b) of FIG. 8, it is understood that when the downstream discharge current Ip(S) is made large, a change amount (slope, change rate) α of the surface potential of the photosensitive drum 1 relative to the change of 100 μA in downstream discharge current Ip(S) becomes small. Further, from (b) of FIG. 8, it is understood that when the surface potential formed on the photosensitive drum 1 by the upstream charger 31 is small, the slope α becomes large.

In this embodiment, a relationship between the slope α and graininess of an output image is studied, s that a range in which the slope α is 5 V/100 μA or less is a proper range. This slope α is an index indication the convergence property of the surface potential of the photosensitive drum 1 with respect to the downstream grid voltage Vg(S). A smaller value of the slope α shows that the surface potential of the photosensitive drum 1 move converges at the downstream grid voltage Vg(S) and thus a uniform surface potential with no charging non-uniformity can be formed.

As shown in (b) of FIG. 8, when the surface potential Vd(U)dev (at the developing portion d formed on the photosensitive drum 1 by the upstream charger 31 is −400 V, in a range in which the downstream discharge current Ip(S) is larger than −800 V, the value of the slope α can be adjusted to 5 V/100 μA or less. When the downstream discharge current Ip(S) is set at −1200 μA, as shown in (a) of FIG. 8, the surface potential of the photosensitive drum 1 at the developing portion d converges at −500 V which is the target potential and the slope α can be set at 2.5 V/100 μA within the above-described proper range. That is, by setting the downstream discharge current Ip(S) at −1200 μA, it is possible to converge the surface potential of the photosensitive drum 1 at the target potential and also possible to suppress generation of the charging non-uniformity.

As described above, in this embodiment, the surface potential is formed on the photosensitive drum 1 by the upstream charger 31 and then the surface potential is formed by the downstream charger 32 superposedly on (synthetically with) the surface potential formed by the upstream charger 31, so that the photosensitive drum surface potential is controlled to a desired surface potential on the photosensitive drum 1. By using this method, it becomes possible to form a uniform surface potential of the photosensitive drum 1 with no charging non-uniformity.

In this embodiment, the target value of the slope α was 5 V/100 μA or less, and the target value of the surface potential of the photosensitive drum 1 at the developing portion d after the charging process by the downstream charger 32 was −500 V. In this case, the potential difference between the downstream grid voltage Vg(S) and the surface potential Vd(U)dev (at the developing portion d) formed on the photosensitive drum 1 by the upstream charger 31 was set at 200 V. However, the present invention is not limited to the potential difference in the above-described setting, but the potential difference may also be appropriately adjusted depending on the dark decay which is a charging characteristic and a discharging characteristic of the chargers.

6. Procedure of Adjusting Operation of Charging Voltage

Figure 9:
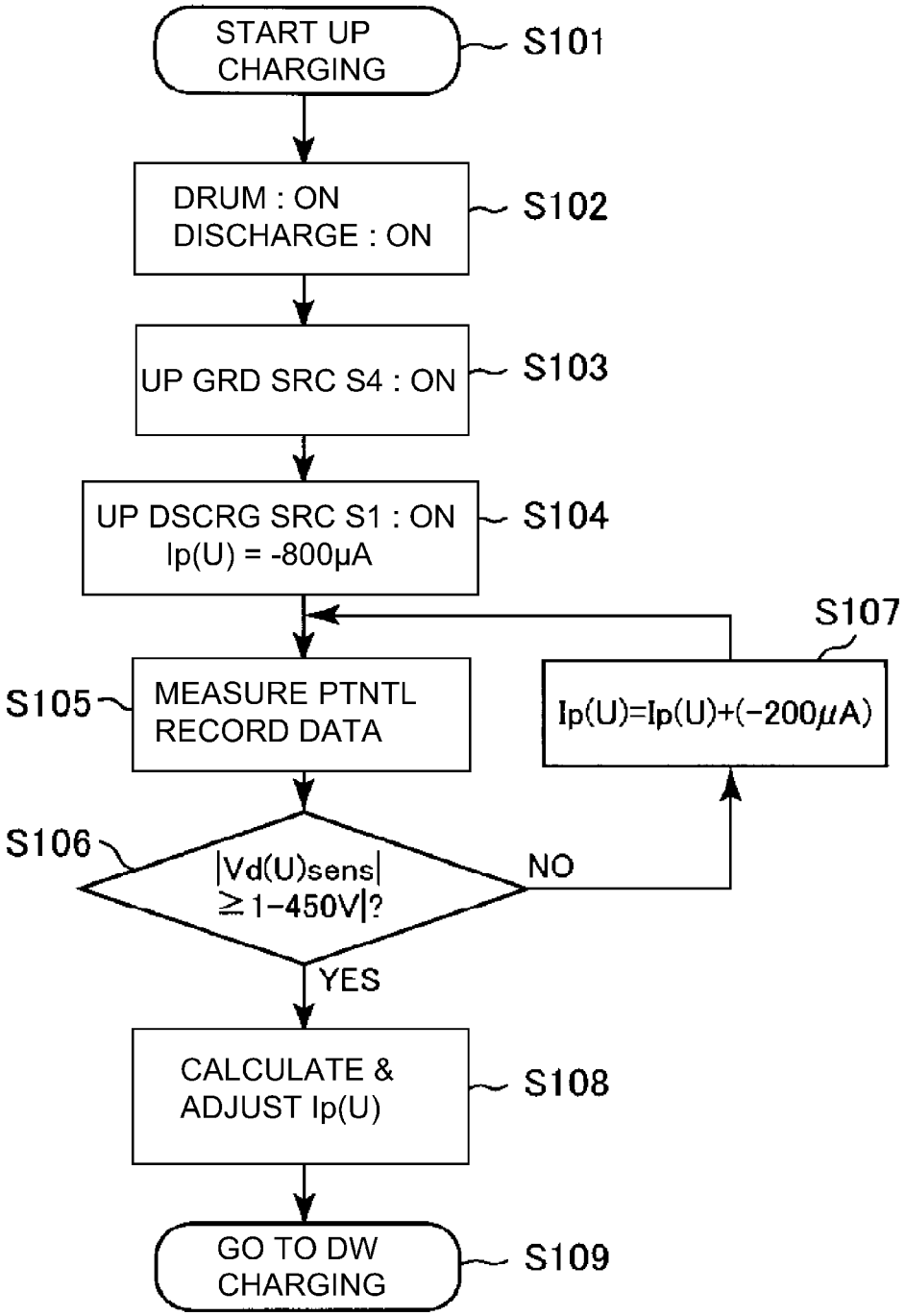
FIG. 9 is a flowchart showing a procedure of a control operation of a photosensitive drum surface potential by the upstream charger in the Embodiment 1.
Figure 10:
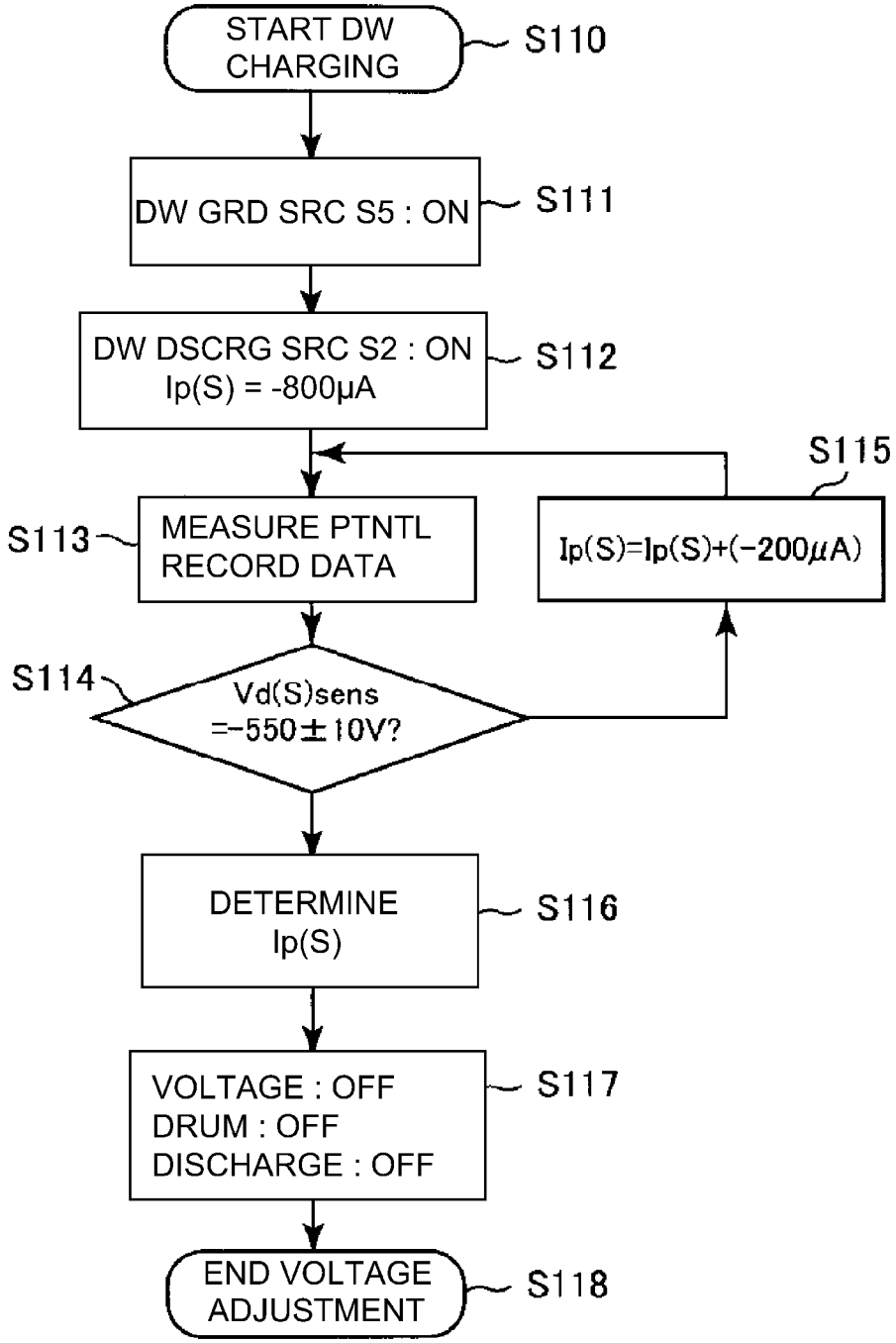
FIG. 10 is a flowchart showing a procedure of a control operation of the photosensitive drum surface potential by the downstream charger in the Embodiment 1.

A procedure of an adjusting operation of the charging voltage in this embodiment will be described with reference to FIGS. 9 and 10. In this embodiment, the CPU 200 as a control means controls the adjusting operation of the charging voltage in the following procedure. The CPU 200 executes the charging voltage adjusting operation at predetermined timing during non-image formation.

Here, "during the non-image formation" refers to a period other than during image formation in which formation (formation of the electrostatic latent image, formation of the toner image and transfer of the toner image) of the image formed on the recording material P and then outputted is made. Examples of "during the non-image formation" include during a pre-multi-rotation step which is a preparatory operation during power on of the image forming apparatus 100 or during restoration from a sleep state of the image forming apparatus 100; during a pre-rotation step which is a preparatory operation from input of image formation start instruction until the image is actually formed; during a sheet interval corresponding to an interval between consecutive two recording materials P in a job for continuously form images on a plurality of recording materials (in a series of operations for forming the image on a single recording material P or plurality of recording materials P by single image formation start instruction); and during a post-rotation step which is a post-operation (preparatory operation) after the image is formed.

In this embodiment, the CPU 200 is capable of obtaining pieces of information including a result of counting of image output sheet number by a sheet number counter 300, a measurement result of an elapsed time by a timer 400, and a detection result of at least one of a temperature and a humidity by an environment sensor 500. Then, on the basis of at least one of these pieces of information, the CPU 200 is capable of discriminating a timing of execution of the charging voltage adjusting operation. For example, in the case where the image output sheet number from the time of preceding execution reaches a predetermined image output sheet number, the charging voltage adjusting operation ca be executed in a subsequent pre-rotation step. In the case where the image output sheet number reaches the predetermined image output sheet number during the execution of the job, the charging voltage adjusting operation may also be executed during the sheet interval. In place of or in addition to the image output sheet number, on the basis of an elapsed time from the preceding execution, the charging voltage adjusting operation may also be executed. Further, in place of or in addition to the image output sheet number or the elapsed time, in the case where at least one of ambient temperature and ambient humidity changes to exceed a predetermined threshold, the charging voltage adjusting operation may also be performed.

6-1. Charging Process by Upstream Charger and Surface Potential Control

First, with reference to FIG. 9, the charging process by the upstream charger 31 and control of the surface potential of the photosensitive drum 1 will be described. In this embodiment, the voltage is set by the upstream charger 31 and the downstream charger 32 so as to be set at −550±10 V (first potential) which is a target value.

When the timing is a timing when the charging voltage adjusting operation is executed (S101), the CPU 200 causes the photosensitive drum 1 to start rotational drive and also causes the light charge-removing device to start exposure of the photosensitive drum 1 to light (S102). Then, after the rotation of the photosensitive drum 1 reaches steady-state rotation, an upstream grid voltage is applied from the upstream grid voltage source S4 to the upstream grid electrode 31*b* (S103). Thereafter, the CPU 200 causes the upstream discharge voltage source S1 to apply the upstream discharge current to the upstream discharge wire 31*a* (S104). Then, the CPU 200 causes the potential sensor 5 to measure the surface potential formed on the photosensitive drum 1 by the upstream charger 31 and then causes the storing portion 600 to store a measured surface potential (S105). Then, the CPU 200 discriminates whether or not the measured surface potential of the photosensitive drum 1 is not less than −450 V (second potential) which is a target value at the potential detecting portion c for detecting the surface potential formed on the photosensitive drum 1 by the upstream charger 31 (S106). Here, a relationship between the first potential and the second potential is such that they have the same polarity and that an absolute value of the second potential is less than an absolute value of the first potential.

In the case where the CPU 200 discriminates that the surface potential of the photosensitive drum 1 is smaller than −450 V in S106, the CPU 200 increases the upstream discharge current by −200 μA (S107), and then repeats processing of S105 and S106. On the other hand, in the case where the CPU 200 discriminates that the surface potential of the photosensitive drum is not less than −450 V in S106, the CPU 200 adjusts the upstream discharge current Ip(U) applied from the upstream discharge voltage source S1 to the upstream discharge wire 31*a* in the following manner (S108). That is, on the basis of the relationship (as shown in FIG. 5) between the upstream discharge current and the surface potential of the photosensitive drum 1 which are measured until the last measurement, a value of the upstream discharge current Ip(U) at which the surface potential of the photosensitive drum 1 at the developing portion d is −400 V is calculated, so that the upstream discharge current Ip(U) is adjusted so as to be the calculated value. In the case where the value of the upstream discharge current Ip(U) is set in S108, the sequence goes to the charging process by the downstream charger 32 and control of the surface potential of the photosensitive drum 1 (S109).

6-2. Charging Process by Downstream Charger and Surface Potential Control

First, with reference to FIG. 10, the charging process by the downstream charger 32 and control of the surface potential of the photosensitive drum 1 will be described.

In a state in which the charging process of the photosensitive drum 1 by the upstream charger 31 is continued under a charging condition adjusted as described above, the CPU 200 causes the downstream charger 32 to start the charging process of the photosensitive drum 1 (S110). Then, an downstream grid voltage is applied from the downstream grid voltage source S6 to the downstream grid electrode 32*b* (S111). Thereafter, the CPU 200 causes the downstream discharge voltage source S2 to apply the upstream discharge current to the downstream discharge wire 32*a* (S112). Then, the CPU 200 causes the potential sensor 5 to measure the surface potential formed on the photosensitive drum 1 by the upstream charger 31 and then causes the storing portion 600 to store a measured surface potential (S113). Then, the CPU 200 discriminates whether or not the measured surface potential of the photosensitive drum 1 is within a range of −550±10 V (first potential) which is a target value at the potential detecting portion c for detecting the surface potential formed on the photosensitive drum 1 by the downstream charger 32 (S114).

In the case where the CPU 200 discriminates that the surface potential of the photosensitive drum 1 is smaller than the above range in S114, the CPU 200 increases the downstream discharge current by −200 μA (S115), and then repeats processing of S113 and S114. In this embodiment, the downstream discharge current is started to be applied from a sufficiently small value and therefore is successively increased so that the surface potential of the photosensitive drum 1 is caused to converge within the range of −550±10 V which is the target value. However, the present invention is not limited thereto, but in the case where the CPU 200 discriminates that the surface potential of the photosensitive drum 1 is larger than the above range, such a processing that the downstream discharge current is decreased by a predetermined value may also be performed. On the other hand, in the case where the CPU 200 discriminates that the surface potential of the photosensitive drum 1 reaches the above range in S114, the CPU 200 determines the downstream discharge current Ip(S) as a value at that time and ends the adjustment of the downstream discharge current Ip(S) (S116).

Thereafter, the CPU 200 turns off the voltage sources S1, S2, S4 and S5 and also turns off the rotational drive of the photosensitive drum 1 and the light exposure by the light charge-removing device 4, so that the charging voltage adjusting operation is ended (S118).

By the above-described procedure, the adjustment to the charging condition for charging the photosensitive drum 1 to the target surface potential can be made.

As described above, the image forming apparatus 100 includes the voltage applying means S1, S2, S4, S5 for applying the charging voltage for electrically charging the photosensitive drum 1 to the plurality of corona chargers 31 and 32 of the charging device 3. The image forming apparatus 100 further includes the control means 200 for independently controlling the charging voltages applied from the voltage applying means S1, S2, S4, S5 to the plurality of corona chargers 31 and 32. The control means 200 executes the adjusting operation for adjusting the charging voltages applied to the plurality of corona chargers 31 and 32 by the voltage applying means S1, S2, S4, S5. In the adjusting operation, the control means 200 performs the following operation. First, the control means adjusts the charging voltage applied to the upstream corona charger by the voltage applying means so that the surface potential formed on the photosensitive member by the charging process by the corona charger, of the adjacent two corona chargers of the plurality of corona chargers, disposed in an upstream side with respect to the rotational direction of the photosensitive member. Thereafter, the charging voltage applied to the downstream corona charger so that the surface potential formed superposedly on the surface potential, formed on the upstream corona charger, by the charging process by the downstream corona charger of the above-described adjacent two corona chargers becomes the predetermined target value. Such an operation that the voltages applied to the upstream corona charger and the downstream corona charger are adjusted is successively performed from the upstreammost corona charger to the downstreammost corona charger of the plurality of corona chargers with respect to the rotational direction of the photosensitive member.

As described above, in this embodiment, even in the case where the moving speed of the photosensitive drum 1 is increased or the photosensitive drum 1 having a relatively large electrostatic capacity is used, the photosensitive drum 1 can be charged uniformly to the target surface potential by the plurality of corona chargers 31 and 32. In this embodiment, the voltages applied to the plurality of corona chargers 31 and 32 can be independently controlled. Then, in this embodiment, such an adjusting operation of the charging voltage that the surface potentials formed on the photosensitive drum 1 by independently controlling the voltages successively applied to the plurality of corona chargers in the order from the upstream side to the downstream side in the superposition (synthesis) manner is performed. As a result, the voltages applied to the corona chargers 31 and 32 are independently set, so that a final surface potential of the photosensitive drum 1 can be controlled to a desired potential. Particularly, in this embodiment, the surface potential formed on the photosensitive drum 1 is sufficiently increased within a good range of convergence property to the downstream grid voltage. In this embodiment, of the final target potentials of the photosensitive drum 1, the surface potential formed on the photosensitive drum 1 by the upstream charger 31 is larger than the surface potential formed superposedly by the downstream charger 32. As a result, even when the voltage applied to (the current supplied to) the downstream charger 32 is relatively small, it is possible to decrease degree of a fluctuation in surface potential of the photosensitive drum 1 relative to a fluctuation in current supplied to the downstream charger 32. As described above, according to this embodiment, the voltages applied to the respective controls 31 and 32 can be controlled independently to proper voltages at which the charging non-uniformity of the photosensitive drum 1 is easily suppressed. Therefore, according to this embodiment, in the constitution in which the photosensitive drum 1 is charged by the plurality of controls 31 and 32, even in the case where the currents supplied to the corona chargers 31 and 32 fluctuate, the charging non-uniformity of the photosensitive member can be suppressed.

Embodiment 2

Another embodiment of the present invention will be described Basic constitution and operation of an image forming apparatus in this embodiment are the same as those in Embodiment 1. Accordingly, in the image forming apparatus in this embodiment, elements having functions or constitutions identical or corresponding to those for the image forming apparatus in Embodiment 1 are represented by the same reference numerals or symbols and will be omitted from detailed description.

1. Summary of this Embodiment

In Embodiment 1, the upstream grid voltage and the downstream grid voltage were fixed, and the surface potential was controlled by independently adjusting the upstream discharge current and the downstream discharge current. As a result, the adjustment to the charging condition for charging the photosensitive drum 1 uniformly to the target surface potential can be made. However, in the case where there is a variation in charging characteristic of the photosensitive drum 1 to a certain extent or more or in the case where the gap between the discharge wire and the grid electrode fluctuated due to a tolerance or the like to a certain extent or more, it would be considered that it is difficult to adjust the surface potential of the photosensitive drum 1 to the target potential.

In this embodiment, the upstream grid voltage and the downstream grid voltage are variably adjusted, so that the surface potential of the photosensitive drum 1 is controlled. Further, in this embodiment, in order to make the slope $\alpha$ shown in (b) of FIG. 8 smaller than that shown in (b) of FIG. 8, control is effected so that the potential difference between the surface potential (at the developing portion d) formed on the photosensitive drum 1 by the upstream charger 31 and the downstream grid voltage is smaller than that in Embodiment 1. As a result, it is possible to realize improvement in control accuracy of the surface potential of the photosensitive drum 1 and reduction in degree of the charging non-uniformity of the photosensitive drum 1.

2. Control of Surface Potential of Photosensitive Drum 2-1. Charging Process by Upstream Charger First, the charging process by the upstream charger 31 will be described. The predetermined upstream discharge current Ip(U) is applied from the upstream discharge voltage source S1 to the discharge wire 31*a*, and the upstream charger 31 charges the photosensitive drum 1 under application of the upstream grid voltage Vg(U) from the upstream grid voltage source S4 to the upstream grid electrode 31*b*.

Figure 11:
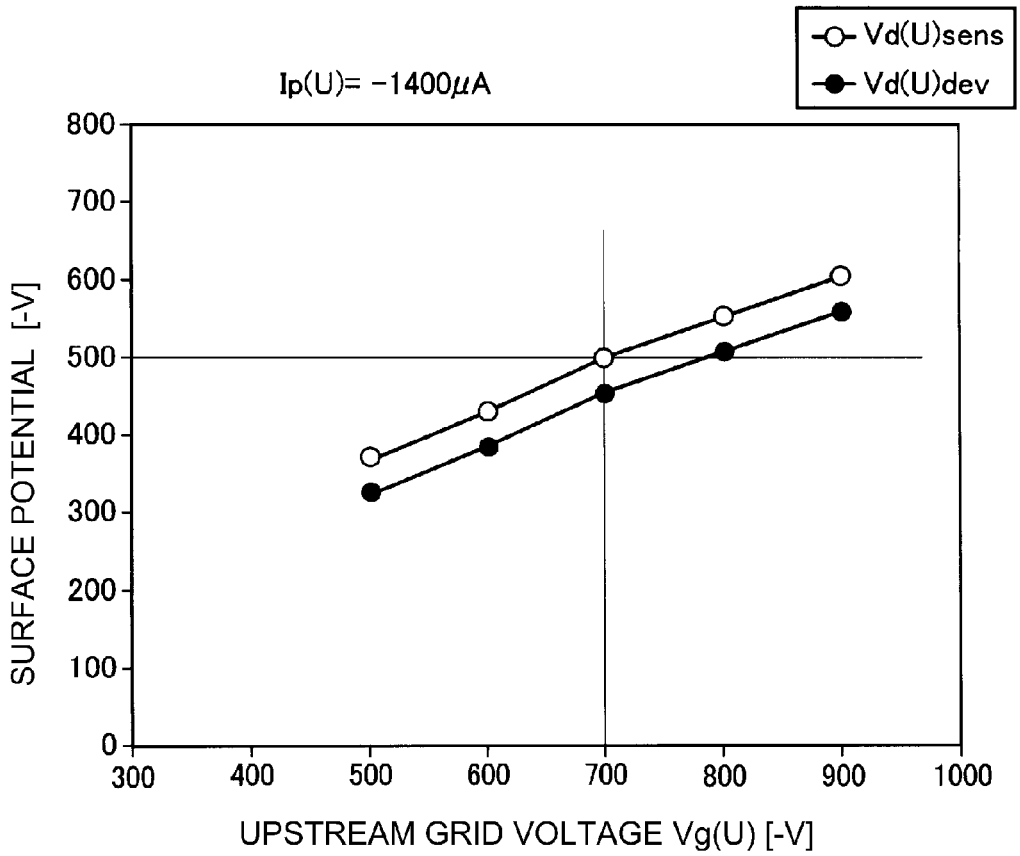
FIG. 11 is a graph showing a relationship between an upstream grid voltage of an upstream charger and a photosensitive drum surface potential in Embodiment 2.

FIG. 11 shows a relationship between the upstream grid voltage Vg(U) and the surface potential of the photosensitive drum 1 after being charged by the upstream charger 31. The upstream discharge current Ip(U) was −1400 μA. In this embodiment, similarly as in Embodiment 1, the peripheral speed of the photosensitive drum 1 is 700 mm/s.

As shown in FIG. 11, the surface potential formed on the photosensitive drum 1 varies depending on the upstream grid voltage Vg(U). In this embodiment, in the case where the upstream grid voltage Vg(U) is −700 V and the upstream discharge current Ip(U) is −1400 μA, the surface potential of the photosensitive drum 1 is −500 V at the potential detecting portion c and −450 V at the developing portion d.

In this embodiment, the voltage applied to the upstream charger 31 is adjusted so that a surface potential Vd(U)sens of the photosensitive drum 1 at the potential detecting portion c is −500 V (and a surface potential Vd(U)dev of the photosensitive drum 1 at the developing portion d is −450 V) while adjusting the upstream grid voltage Vg(U) in a variable change manner.

2-2. Charging Process by Downstream Charger

Next, the charging process by the downstream charger 32 will be described. Adjustment of the voltage applied to the downstream charger 32 is made in a state in which the above-described charging process by the upstream charger 31 is continued. The predetermined downstream discharge current (DC current) Ip(S) is applied from the downstream discharge voltage source S2 to the downstream discharge wire 32*a*, and the downstream charger 32 charges the photosensitive drum 1 under application of the downstream grid voltage Vg(S) from the downstream grid voltage source S5 to the downstream grid electrode 32*b*.

Figure 12:
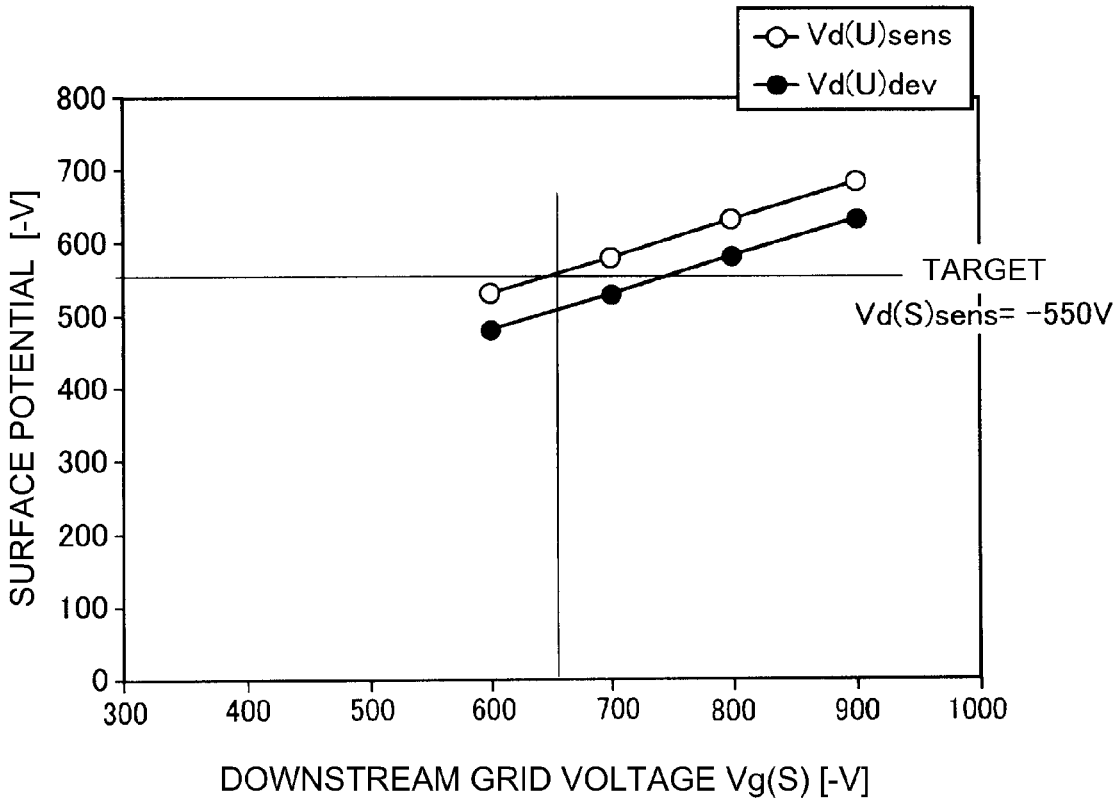
FIG. 12 is a graph showing a relationship between a downstream grid voltage of a downstream charger and the photosensitive drum surface potential in the Embodiment 2.

FIG. 12 shows a relationship between the downstream grid voltage Vg(S) and the surface potential of the photosensitive drum 1 after being charged by the downstream charger 32. As shown in FIG. 12, the surface potential formed on the photosensitive drum 1 varies depending on the downstream grid voltage Vg(S). In this embodiment, in the case where the downstream grid voltage Vg(S) is −650 V and the downstream discharge current Ip(S) is −1600 μA, the surface potential of the photosensitive drum 1 is −550 V at the potential detecting portion c and −500 V at the developing portion d.

2-3. Relationship Between Surface Potentials Formed by Upstream Charger and Downstream Charger In FIG. 13, (a) shows a relationship between the downstream discharge current Ip(S) and the surface potential Vd(S)sens of the photosensitive drum 1 at the potential detecting portion c after the charging process by the downstream charger 32 in the case where the downstream grid voltage Vg(S) is fixed at −650 V. As shown in (a) of FIG. 13, in the case where the downstream grid voltage Vg(S) is −650 V and the downstream discharge current Ip(S) is −1600 μA, the surface potential of the photosensitive drum 1 at the potential detecting portion c converges at −550 V.

Figure 13:
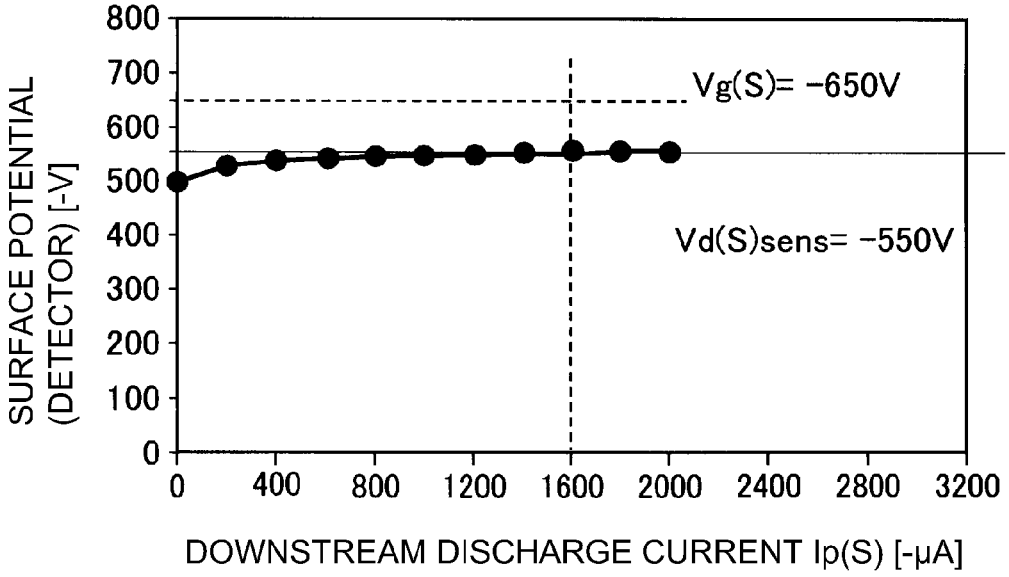
In FIG. 13, (a) is a graph showing a relationship between the downstream discharge current and the surface potential of the photosensitive drum in the Embodiment 2, and (b) is a graph showing a relationship between the downstream discharge current and a slope of a change in potential in the Embodiment 2.
Figure 13:
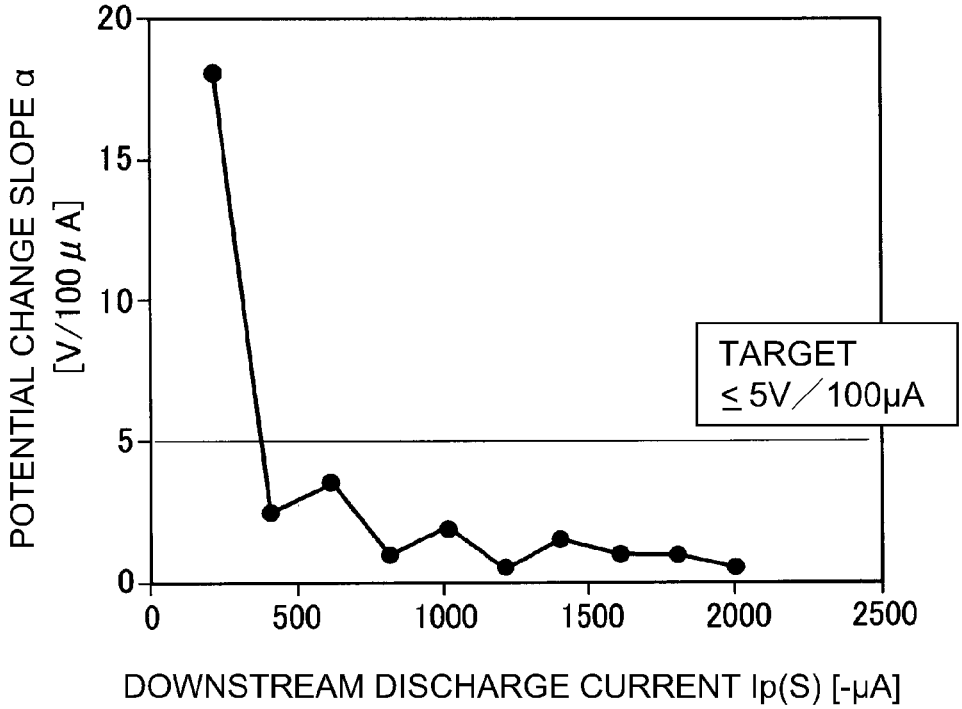

In FIG. 13, (b) shows a relationship between the downstream discharge current Ip(S) and an amount of a change in surface potential of the photosensitive drum 1 relative to a change of 100 μA in downstream discharge current Ip(S) in the case where the downstream grid voltage Vg(S) is fixed at −650 V. From (b) of FIG. 13, it is understood that in the case where the downstream grid voltage Vg(S) is −650 V and the downstream discharge current Ip(S) is −1600 μA, a change amount (slope, change rate) α of the surface potential of the photosensitive drum 1 relative to a change in downstream discharge current Ip(S) can be reduced by 2 V/100 μA. That is, it is understood that a uniform surface potential can be formed on the photosensitive drum 1.

3. Procedure of Adjusting Operation of Charging Voltage

Figure 14:
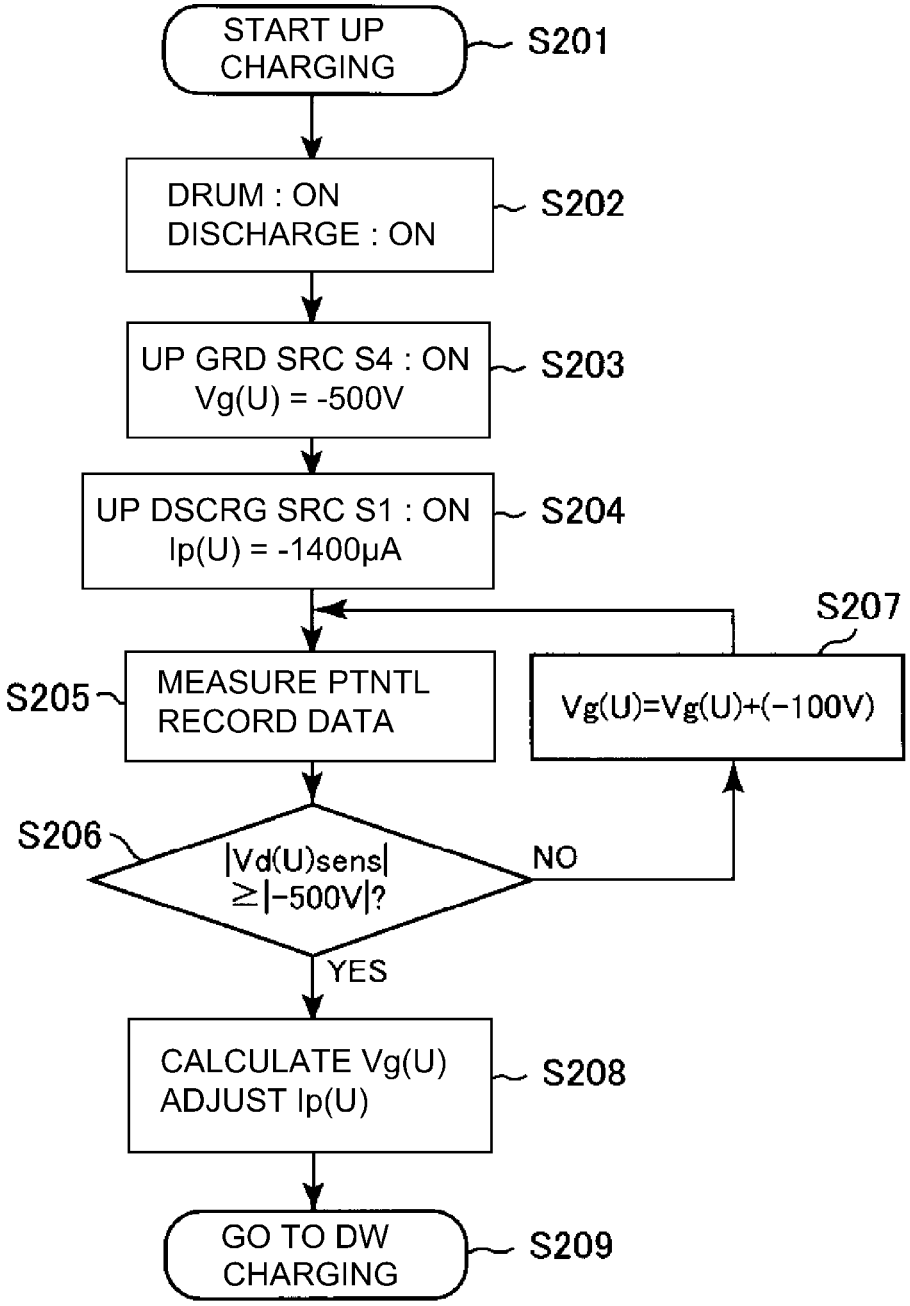
FIG. 14 is a flowchart showing a procedure of a control operation of a photosensitive drum surface potential by the upstream charger in the Embodiment 2.
Figure 15:
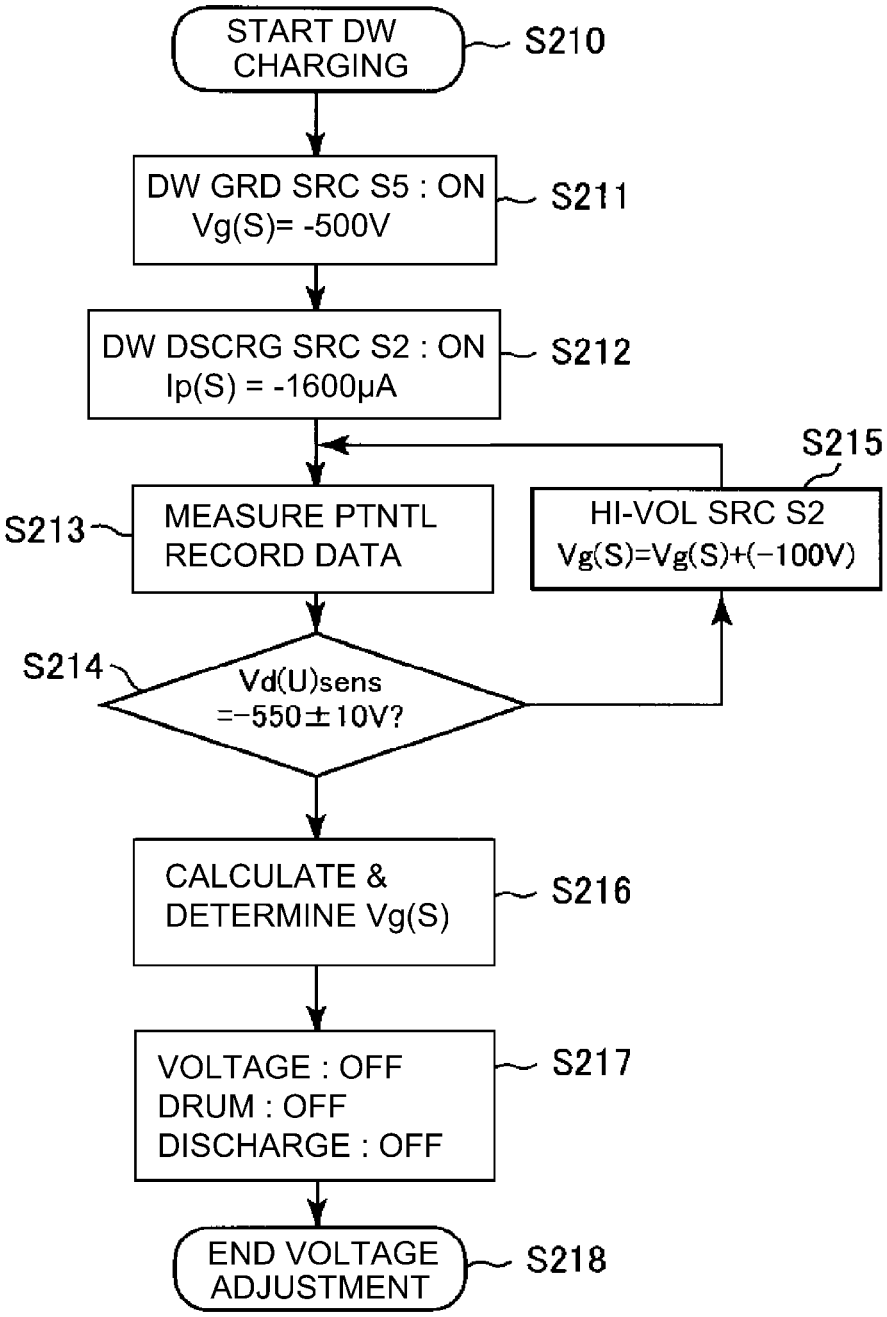
FIG. 15 is a flowchart showing a procedure of a control operation of the photosensitive drum surface potential by the downstream charger in the Embodiment 2.

A procedure of an adjusting operation of the charging voltage in this embodiment will be described with reference to FIGS. 14 and 15. In this embodiment, the CPU 200 as a control means controls the adjusting operation of the charging voltage in the following procedure.

3-1. Charging Process by Upstream Charger and Surface Potential Control

First, with reference to FIG. 14, the charging process by the upstream charger 31 and control of the surface potential of the photosensitive drum 1 will be described.

When the timing is a timing when the charging voltage adjusting operation is executed (S201), the CPU 200 causes the photosensitive drum 1 to start rotational drive and also causes the light charge-removing device to start exposure of the photosensitive drum 1 to light (S202). Then, after the rotation of the photosensitive drum 1 reaches steady-state rotation, an upstream grid voltage is applied from the upstream grid voltage source S4 to the upstream grid electrode 31*b* (S203). Thereafter, the CPU 200 causes the upstream discharge voltage source S1 to apply the upstream discharge current to the upstream discharge wire 31*a* (S204). Then, the CPU 200 causes the potential sensor 5 to measure the surface potential formed on the photosensitive drum 1 by the upstream charger 31 and then causes the storing portion 600 to store a measured surface potential (S205). Then, the CPU 200 discriminates whether or not the measured surface potential of the photosensitive drum 1 is not less than −50 V which is a target value at the potential detecting portion c for detecting the surface potential formed on the photosensitive drum 1 by the upstream charger 31 (S206).

In the case where the CPU 200 discriminates that the surface potential of the photosensitive drum 1 is smaller than −500 V in S106, the CPU 200 increases the upstream grid voltage by −100 V (S207), and then repeats processing of S205 and S206. On the other hand, in the case where the CPU 200 discriminates that the surface potential of the photosensitive drum is not less than −500 V in S206, the CPU 200 adjusts the upstream grid voltage Vg(U) applied from the upstream grid voltage source S4 to the upstream grid electrode 31*b* in the following manner (S208). That is, on the basis of the relationship (as shown in FIG. 11) between the upstream grid voltage and the surface potential of the photosensitive drum 1 which are measured until the last measurement, a value of the upstream grid voltage Vg(U) at which the surface potential of the photosensitive drum 1 at the developing portion d is −450 V is calculated, so that the upstream grid voltage Vg(U) is adjusted so as to be the calculated value. In the case where the value of the upstream grid voltage Vg(U) is set in S208, the sequence goes to the charging process by the downstream charger 32 and control of the surface potential of the photosensitive drum 1 (S209).

3-2. Charging Process by Downstream Charger and Surface Potential Control

First, with reference to FIG. 15, the charging process by the downstream charger 32 and control of the surface potential of the photosensitive drum 1 will be described.

In a state in which the charging process of the photosensitive drum 1 by the upstream charger 31 is continued under a charging condition adjusted as described above, the CPU 200 causes the downstream charger 32 to start the charging process of the photosensitive drum 1 (S210). Then, an downstream grid voltage is applied from the downstream grid voltage source S6 to the downstream grid electrode 32*b* (S211). Thereafter, the CPU 200 causes the downstream discharge voltage source S2 to apply the upstream discharge current to the downstream discharge wire 32*a* (S212). Then, the CPU 200 causes the potential sensor 5 to measure the surface potential formed on the photosensitive drum 1 by the upstream charger 31 and then causes the storing portion 600 to store a measured surface potential (S213). Then, the CPU 200 discriminates whether or not the measured surface potential of the photosensitive drum 1 is within a range of −550±10 V which is a target value at the potential detecting portion c for detecting the surface potential formed on the photosensitive drum 1 by the downstream charger 32 (S214).

In the case where the CPU 200 discriminates that the surface potential of the photosensitive drum 1 is smaller than the above range in S214, the CPU 200 increases the downstream grid voltage by −100 V (S215), and then repeats processing of S213 and S214. In this embodiment, the downstream grid voltage is started to be applied from a sufficiently small value and therefore is successively increased so that the surface potential of the photosensitive drum 1 is caused to converge within the range of −550±10 V which is the target value. However, the present invention is not limited thereto, but in the case where the CPU 200 discriminates that the surface potential of the photosensitive drum 1 is larger than the above range, such a processing that the downstream grid voltage is decreased by a predetermined value may also be performed. On the other hand, in the case where the CPU 200 discriminates that the surface potential of the photosensitive drum 1 reaches the above range in S214, the CPU 200 determines the downstream grid voltage Vg(S) as a value at that time and ends the adjustment of the downstream grid voltage Vg(S) (S216).

Thereafter, the CPU 200 turns off the voltage sources S1, S2, S4 and S5 and also turns off the rotational drive of the photosensitive drum 1 and the light exposure by the light charge-removing device 4, so that the charging voltage adjusting operation is ended (S218).

By the above-described procedure, the charging voltage is controlled to the charging condition for charging the photosensitive drum 1 to the target surface potential can be made.

Embodiment 3

A further embodiment of the present invention will be described Basic constitution and operation of an image forming apparatus in this embodiment are the same as those in Embodiment 1. Accordingly, in the image forming apparatus in this embodiment, elements having functions or constitutions identical or corresponding to those for the image forming apparatus in Embodiment 1 are represented by the same reference numerals or symbols and will be omitted from detailed description.

In Embodiments 1 and 2, the charging device 3 had the constitution in which the charging process of the photosensitive drum 1 was performed by the two corona chargers for which the applied voltages are independently controllable. In this embodiment, a charging device 3 has a constitution in which the charging process of the photosensitive drum 1 is performed by three corona chargers for which applied voltages are independently controllable. As a result, even in the case where the moving speed of the photosensitive drum 1 is further increased, the charging performance of the charging device 3 is enhanced, so that it becomes possible to obtain a uniform surface potential of the photosensitive drum 1.

Figure 16:
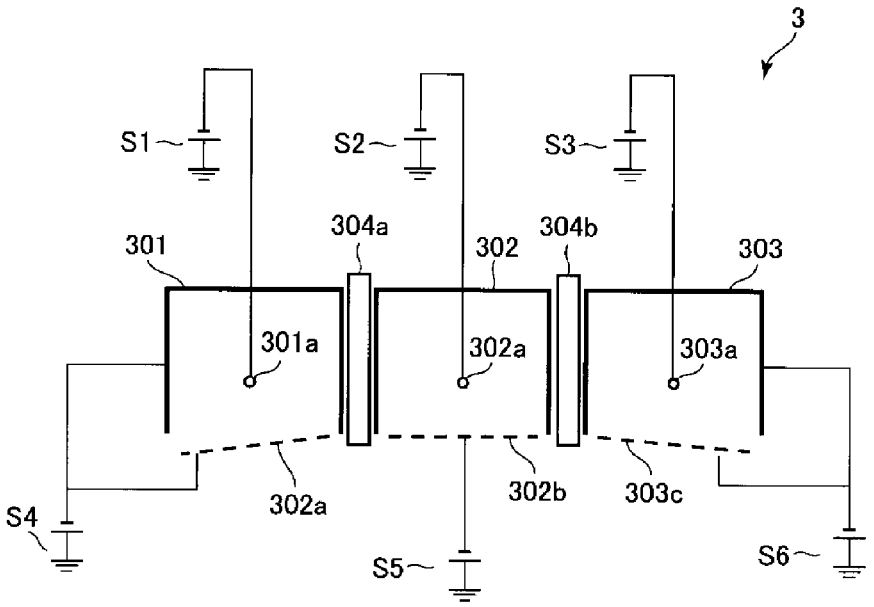
FIG. 16 is a schematic sectional view of a charging device in Embodiment 3.

FIG. 16 is a schematic sectional view of the charging device 3 in this embodiment. The charging device 3 in this embodiment is constituted by the upstream charger 301, in intermediary charger 302 and a downstream charger 303 which are three scorotron chargers as a plurality of corona chargers. With respect to the rotational direction of the photosensitive drum 1, the upstream charger 301, the intermediary charger 302 and the downstream charger 303 are disposed from an upstream side toward a downstream side in this order. These three chargers 301, 302, 303 have substantially the same constitution. That is, these three chargers 301, 302, 303 include discharge wires (wire electrodes, discharge electrodes) 301*a*, 302*a*, 303*a*, grid electrodes 301*b*, 302*b*, 303*b* and shield electrodes 301*c*, 302*c*, 303*c*. Incidentally, in the following description, elements and various parameters for each of the upstream charger 301, the intermediary charger 302 and the downstream charger 303 are distinguished from each other by adding the prefix "upstream", "intermediary" or "downstream" in some cases.

The discharge wires 301*a*, 302*a*, 303*a*, the grid electrodes 301*b*, 302*b*, 303*b*, and the shield electrodes 301*c*, 302*c*, 303*c* have the same constitutions as those in the charging devices 3 in Embodiments 1 and 2. Further, in this embodiment, insulating members 304*a* and 304*b* are provided between the upstream charger 301 and the intermediary charger 302 and between the intermediary charger 302 and the downstream charger 303, respectively. The insulating members 304*a*, 304*b* have the same constitution as that in the charging devices 3 in Embodiments 1 and 2.

As shown in FIG. 16, each of the upstream grid electrode 301, the intermediary grid electrode 302 and the downstream grid electrode 303 is disposed along curvature of the photosensitive drum 1 so that the grid electrodes 31*b* and 32*b* have different angles (inclination angles). Similarly as in Embodiments 1 and 2, in a cross-section substantially perpendicular to the longitudinal direction of the photosensitive drum 1, an arrangement angle of each of the grid electrodes 301*b*, 302*b*, 303*b* is a substantially right angle with respect to a rectilinear line connecting the associated discharge wire 301*a*, 302*a* or 303*a* with the rotation center of the photosensitive drum 1. Similarly as in Embodiments 1 and 2, a width (with respect to a tangential direction of the photosensitive drum 1) of each of the chargers 301, 302, 303 is 20 mm, i.e., the same. In this embodiment, an aperture (ratio) of each of the grid electrodes 301*b*, 302*b*, 303*b* is 85%, i.e., the same. Commonality of the grid electrodes 301*b*, 302*b*, 303*b* is achieved, so that the number of parts during maintenance can be reduced.

By employing the above-described constitution, even in the case where the peripheral speed of the photosensitive drum 1 is 1000 mm/s, the charging device 3 in this embodiment is capable of uniformly charging the photosensitive drum 1.

As shown in FIG. 16, the upstream discharge wire, the intermediary discharge wire 302*a* and the downstream discharge wire 303*a* are connected to an upstream discharge voltage source S1, an intermediary discharge voltage source S2 and a downstream discharge voltage source S2, respectively, which are DC voltage sources (high-voltage sources). As a result, voltages applied to the discharge wires 301*a*, 302*a*, 303*a* can be independently controlled. The upstream grid electrode 301*b*, the intermediary grid electrode 302*b* and the downstream grid electrode 302*b* are connected to an upstream grid voltage source S4, an intermediary grid voltage source S5 and a downstream grid voltage source S6, respectively, which are DC voltage sources. As a result, voltages applied to the grid electrodes 301*b*, 302*b*, 303*b* can be independently controlled.

The upstream shield electrode 301*c*, the intermediary shield electrode 302*c*, and the downstream shield electrode 303*c* are connected with the upstream grid electrode 301*b*, the intermediary grid electrode 302*b* and the downstream grid electrode 303*b*, respectively. In this way, in this embodiment, in the chargers 301, 302 and 303, the shield electrodes 301*c*, 302*c*, 303*c* and the grid electrodes 301*b*,

302*b*, 303*b* have the same potential. However, similarly as described in Embodiment 1, the present invention is not limited thereto.

A control mode of the charging voltage in this embodiment is similar to that in Embodiment 1 shown in FIG. 4, but as the voltage sources, the upstream discharge voltage source S1, the intermediary discharge voltage source S2, the downstream discharge voltage source S3, the upstream grid voltage source S4, the intermediary grid voltage source S5 and the downstream grid voltage source S6 are provided.

The type of control of the voltage applied to the charging device 3 in this embodiment may be either of the type in which the discharge current is controlled similarly as in Embodiment 1 and the type in which the grid voltage is controlled similarly as in Embodiment 2.

The charging device 3 in this embodiment includes the three corona chargers, and therefore in the adjusting operation of the charging voltage, the number of times of execution of an operation for independently adjusting the voltages applied to the respective corona chargers is increased by once compared with those in Embodiments 1 and 2.

An outline of the adjusting operation of the charging voltage in this embodiment will be described using a schematic model view of FIG. 17. With respect to a specific procedure of the charging voltage adjustment in this embodiment, the procedures described in Embodiments 1 and 2 can be applied, and therefore redundant description will be omitted.

Figure 17:
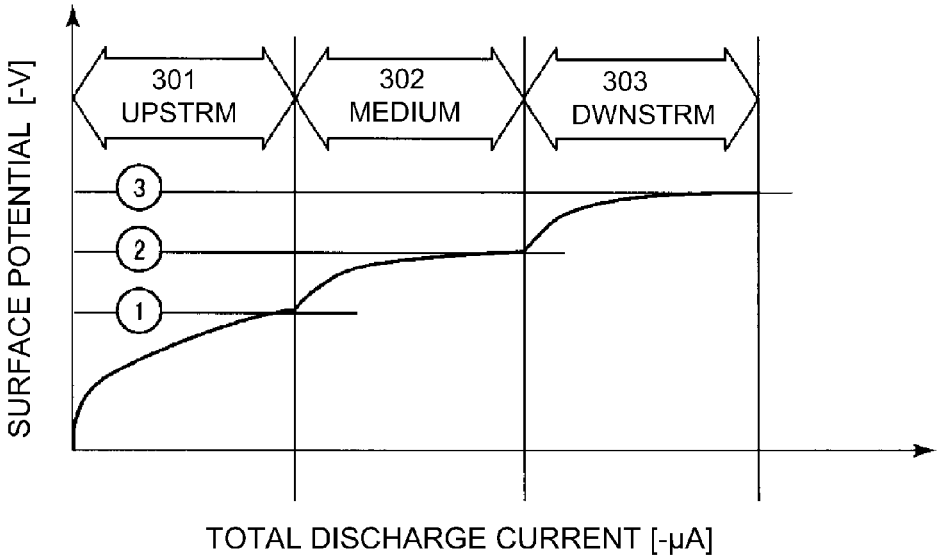
FIG. 17 is a schematic view showing a model of a surface potential formed on a photosensitive drum by each of chargers in the Embodiment 3.

FIG. 17 is a schematic model view showing a relationship between a total discharge current and a surface potential of the photosensitive drum 1 when the photosensitive drum 1 is successively charged by the chargers 301, 302, 303 in the charging voltage adjusting operation in this embodiment. In this embodiment, similarly as in Embodiment 1, predetermined grid voltages are applied to the grid electrodes 301*b*, 302*b*, 303*b*, and discharge currents applied to the discharge electrodes 301*a*, 302*a*, 303*a* are adjusted variably, so that control of the surface potential of the photosensitive drum 1 is effected.

In this embodiment, as shown by (a), (2), (3) in FIG. 17, the charging process of the photosensitive drum 1 is performed in the order of the upstream charger 301, the intermediary (medium) charger 302 and the downstream charger 303, so that the surface potentials are formed successively on the photosensitive drum 1 in a superposition (synthesis) manner. The surface potentials formed on the photosensitive drum 1 by the respective chargers 301, 302, 303 are basically controlled by the same procedure as that in Embodiment 1, so that the surface potentials are finally controlled to target surface potentials. At this time, the surface potential formed on the photosensitive drum 1 by the upstream corona charger of the adjacent two controls may desirably be not more than the grid voltage of the downstream corona charger of the adjacent two corona chargers. However, a difference between the surface potential formed on the photosensitive drum 1 by the upstream corona charger and the grid voltage of the downstream corona charger may preferably be 200 V or less.

As described above, by increasing the number of the chargers of the charging device 3, even in the case where the moving speed of the photosensitive drum 1 is further increased, the photosensitive drum 1 can be uniformly charged to the target surface potential.

Other Embodiments

The present invention was described above based on specific embodiments, but the present invention is not limited to the above-described embodiments.

For example, in the embodiments described above, the charging device was constituted by including the plurality of scorotron chargers as the plurality of chargers. However, in the case where the type in which the discharge current is controlled similarly as in Embodiment 1, of the plurality of chargers of the charging device, the chargers other than the downstreammost charger may be a scorotron charger or a corotron charger.

In the above-described embodiments, with respect to the number of the corona chargers provided in the charging device, the cases of two and three were described, but the number of the controls may also be four or more. Also in this case, similarly as in the above-described embodiments, the voltages applied to the respective corona chargers may only be required to be adjusted so that the formed surface potentials are target values thereof while successively forming the surface potentials in the superposition (synthesis) manner in the order from the upstream corona charger toward the downstream corona charger.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-245425 filed on Dec. 3, 2014, which is hereby incorporated by reference herein in its entirety.

What is claimed is:

1. An image forming apparatus comprising:

a rotatable photosensitive member;

a first corona charger that electrically charges a surface of said photosensitive member to provide a charged surface;

a second corona charger that electrically charges a surface of said photosensitive member to a first predetermined potential in superposition on said charged surface of said photosensitive member charged by said first corona charger, said second corona charger being provided downstream of said first corona charger with respect to a rotational direction of said photosensitive member;

an image former that forms an image on said photosensitive member charged by said first corona charger and said second corona charger;

a voltage applier that applies voltages to said first corona charger and said second corona charger;

a detector that detects a surface potential of said photosensitive member, said detector being provided downstream of said second corona charger with respect to the rotational direction of said photosensitive member; and a controller that controls the voltages applied to said first corona charger and said second corona charger, wherein said controller is capable of executing a test mode operation in which said first corona charger is operated and said second corona charger is not operated, and a first voltage to be applied to the first corona charger is determined so that the surface potential of said photosensitive member is charged to a second predetermined potential lower in absolute value than the first predetermined potential, and then said first corona charger and said second corona charger are both operated with the thus determined first voltage applied to the first corona charger, and a second voltage to be applied to the second corona charger is determined so that the surface potential of said photosensitive member is charged to the first predetermined potential by said first and second corona chargers, and wherein said controller is capable of controlling said voltage applier to apply the thus determined first voltage to the first corona charger and to apply the thus determined second voltage to the second corona charger during image formation.

2. An image forming apparatus according to claim 1, wherein said controller sets a charging voltage by adjusting a current supplied by said voltage applier to a discharging electrode of each of said first corona charger and said second corona charger.

3. An image forming apparatus according to Claim 1, wherein said each of said first corona charger and said second corona charger includes a wire and a grid.

4. An image forming apparatus according to claim 1, wherein when said controller sets the voltage condition for charging said photosensitive member by said first corona charger so that the surface potential of said photosensitive member is the potential lower in absolute value than the first predetermined potential, the voltage applied to said second corona charger by said voltage applier is turned off.

5. An image forming apparatus according to claim 1, wherein each of said first corona charger and said second corona charger includes a wire and a grid, and $|Vg(S)|-|Vd(U)|\leq|200\ (V)|$ is satisfied when a surface potential formed by said first corona charger is Vd(U) and a voltage applied to a grid electrode of said second corona charger is Vg(S).

6. An image forming apparatus according to claim 1, wherein said first corona charger includes a first wire and a first grid, and wherein said controller determines the first voltage applied to the first wire so as to be the second predetermined potential in a state in which a predetermined voltage is applied to the first grid.

7. An image forming apparatus according to claim 1, wherein said second corona charger includes a second wire and a second grid, and wherein said controller determines the second voltage applied to the second wire so as to be the first predetermined potential in a state in which a predetermined voltage is applied to the second grid.

8. An image forming apparatus according to claim 1, wherein said first corona charger includes a first wire and a first grid, and wherein said controller determines the first voltage applied to the first grid so as to be the second predetermined potential in a state in which a voltage is applied to the first wire so that a predetermined current flows through the first wire.

9. An image forming apparatus according to claim 1, wherein said second corona charger includes a second wire and a second grid, and wherein said controller determines the second voltage applied to the second grid so as to be the first predetermined potential in a state in which a voltage is applied to the second wire so that a predetermined current flows through the second wire.

10. An image forming apparatus according to claim 1, wherein said first corona charger includes a first wire and a first grid and said second corona charger includes a second wire and a second grid, and wherein said controller determines the first voltage applied to the first grid so as to be the second predetermined potential in a state in which a voltage is applied to the first wire so that a predetermined current flows through the first wire, and then in a state in which a voltage is applied to the first wire so that a predetermined current flows through the first wire and the first voltage is applied to the first grid, said controller determines the second voltage applied to the second grid so as to be the first predetermined potential in a state in which a voltage is applied to the second wire so that a predetermined current flows through the second wire.

11. An image forming apparatus comprising:

a rotatable photosensitive member;

a first corona charger that electrically charges a surface of said photosensitive member to provide a charged surface;

a second corona charger that electrically charges a surface of said photosensitive member to a first predetermined potential in superposition on said charged surface of said photosensitive member charged by said first corona charger, said second corona charger being provided downstream of said first corona charger with respect to a rotational direction of said photosensitive member;

an image former that forms an image on said photosensitive member charged by said first corona charger and said second corona charger;

a voltage applier that applies to said first corona charger and said second corona charger;

a detector that detects a surface potential of said photosensitive member, said detector being provided downstream of said second corona charger with respect to the rotational direction of said photosensitive member; and a controller that controls a current flowing through each of said first corona charger and said second corona charger, wherein said controller is capable of executing a test mode operation in which said first corona charger is operated and said second corona charger is not operated, and a first current flowing through the first corona charger is determined so that the surface potential of said photosensitive member is charged to a second predetermined potential lower in absolute value than the first predetermined potential, and then said first corona charger and said second corona charger are both operated with flowing of the thus determined first current through the first corona charger, and a second current flowing through the second corona charger is determined so that the surface potential of said photosensitive member is charged to the first predetermined potential by said first and second corona chargers, and wherein said controller is capable of controlling said voltage applier to flow the thus determined first current to the first corona charger and to flow the thus determined second current to the second corona charger during image formation.

12. An image forming apparatus according to claim 11, wherein said controller sets a charging voltage by adjusting a current supplied by said voltage applier to a discharging electrode of each of said first corona charger and said second corona charger.

13. An image forming apparatus according to claim 11, wherein said each of said first corona charger and said second corona charger includes a wire and a grid.

14. An image forming apparatus according to claim 12, wherein when said controller sets the current condition for charging said photosensitive member by said first corona charger so that the surface potential of said photosensitive member is the potential lower in absolute value than the first predetermined potential, the current applied to said second corona charger by said voltage applier is turned off.

15. An image forming apparatus according to claim 11, wherein each of said first corona charger and said second corona charger includes a wire and a grid, and $|Vg(S)|-|Vd(U)|\leq|200\ (V)|$ is satisfied when a surface potential formed by said first corona charger is Vd(U) and a voltage applied to a grid electrode of said second corona charger is Vg(S).

16. An image forming apparatus according to claim 11, wherein said first corona charger includes a first wire and a first grid, and wherein said controller determines the first current flowing through the first wire so as to be the second predetermined potential in a state in which a predetermined voltage is applied to the first grid.

17. An image forming apparatus according to claim 11, wherein said second corona charger includes a second wire and a second grid, and wherein said controller determines the second current flowing through the second wire so as to be the first predetermined potential in a state in which a predetermined voltage is applied to the second grid.

18. An image forming apparatus comprising:

a rotatable photosensitive member;

a first corona charger that electrically charges a surface of said photosensitive member to provide a charged surface;

a second corona charger that electrically charges a surface of said photosensitive member to a first predetermined potential in superposition on said charged surface of said photosensitive member charged by said first corona charger, said second corona charger being provided downstream of said first corona charger with respect to a rotational direction of said photosensitive member;

an image former that forms an image on said photosensitive member charged by said first corona charger and said second corona charger;

a voltage applier that applies voltages to said first corona charger and said second corona charger;

a detector that detects a surface potential of said photosensitive member, said detector being provided downstream of said second corona charger with respect to the rotational direction of said photosensitive member; and a controller that controls a voltage or a current applied to said first corona charger and said second corona charger, wherein said controller is capable of executing a test mode operation in which said first corona charger is operated and said second corona charger is not operated, and a first voltage or current to be applied to the first corona charger is determined so that the surface potential of said photosensitive member is charged to a second predetermined potential lower in absolute value than the first predetermined potential, and then said first corona charger and said second corona charger are both operated with the thus determined first voltage or current applied to the first corona charger, and a second current to be applied to the second corona charger is determined so that the surface potential of said photosensitive member is charged to the first predetermined potential by said first and second corona chargers, and wherein said controller is capable of controlling said voltage applier to apply the thus determined first voltage or current to the first corona charger and to apply the thus determined second voltage or a current to the second corona charger during image formation.

19. An image forming apparatus according to claim 18, wherein said each of said first corona charger and said second corona charger includes a wire and a grid.

20. An image forming apparatus according to claim 18, wherein when said controller sets the voltage condition for charging said photosensitive member by said first corona charger so that the surface potential of said photosensitive member is the potential lower in absolute value than the first predetermined potential, the voltage applied to said second corona charger by said voltage applier is turned off.

21. An image forming apparatus according to claim 18, wherein each of said first corona charger and said second corona charger includes a wire and a grid, and $|Vg(S)|-|Vd(U)|\leq|200\ (V)|$ is satisfied when a surface potential formed by said first corona charger is Vd(U) and a voltage applied to a grid electrode of said second corona charger is Vg(S).

22. An image forming apparatus according to claim 18, wherein said first corona charger includes a first wire and a first grid, and wherein said controller determines the first voltage applied to the first wire so as to be the second predetermined potential in a state in which a predetermined voltage is applied to the first grid.

23. An image forming apparatus according to claim 18, wherein said second corona charger includes a second wire and a second grid, and wherein said controller determines the second voltage applied to the second wire so as to be the first predetermined potential in a state in which a predetermined voltage is applied to the second grid.

24. An image forming apparatus according to claim 18, wherein said first corona charger includes a first wire and a first grid, and wherein said controller determines the first voltage applied to the first grid so as to be the second predetermined potential in a state in which a voltage is applied to the first wire so that a predetermined current flows through the first wire.

25. An image forming apparatus according to claim 18, wherein said second corona charger includes a second wire and a second grid, and wherein said controller determines the second voltage applied to the second grid so as to be the first predetermined potential in a state in which a voltage is applied to the second wire so that a predetermined current flows through the second wire.

26. An image forming apparatus according to claim 18, wherein said first corona charger includes a first wire and a first grid and said second corona charger includes a second wire and a second grid, and wherein said controller determines the first voltage applied to the first grid so as to be the second predetermined potential in a state in which a voltage is applied to the first wire so that a predetermined current flows through the first wire, and then in a state in which a voltage is applied to the first wire so that a predetermined current flows through the first wire and the first voltage is applied to the first grid, said controller determines the second voltage applied to the second grid so as to be the first predetermined potential in a state in which a voltage is applied to the second wire so that a predetermined current flows through the second wire.

* * * * *